US008973202B2

(12) United States Patent
Fischer et al.

(10) Patent No.: US 8,973,202 B2
(45) Date of Patent: Mar. 10, 2015

(54) ORAL HYGIENE DEVICE, PARTICULARLY A TOOTHBRUSH, AND METHOD FOR THE PRODUCTION THEREOF

(75) Inventors: Franz Fischer, Triegen (CH); Peter Gross, Sempach (CH); Beat Huber, Buron (CH)

(73) Assignee: Trisa Holding AG, Triengen (CH)

( * ) Notice: Subject to any disclaimer, the term of this patent is extended or adjusted under 35 U.S.C. 154(b) by 125 days.

(21) Appl. No.: 13/518,953

(22) PCT Filed: Feb. 4, 2011

(86) PCT No.: PCT/EP2011/000533

§ 371 (c)(1),
(2), (4) Date: Jul. 26, 2012

(87) PCT Pub. No.: WO2011/103962

PCT Pub. Date: Sep. 1, 2011

(65) Prior Publication Data

US 2012/0284944 A1 Nov. 15, 2012

(30) Foreign Application Priority Data

Feb. 26, 2010 (EP) ..... 10001977

(51) Int. Cl.

| | |
|---|---|
| ***A46B 5/00*** | (2006.01) |
| ***A46B 9/04*** | (2006.01) |
| ***A46B 15/00*** | (2006.01) |

(52) U.S. Cl.

CPC ..... *A46B 15/0002* (2013.01); *A46B 5/0062* (2013.01); *A46B 5/007* (2013.01); *A46B 15/0012* (2013.01); *A46B 15/004* (2013.01); *A46B 2200/1066* (2013.01)

USPC ..... 15/167.1; 15/144.1; 15/172

(58) Field of Classification Search

USPC ..... 15/143.1, 144.1, 167.1, 172

See application file for complete search history.

(56) References Cited

U.S. PATENT DOCUMENTS

| | | | |
|---|---|---|---|
| 2,083,217 | A | 6/1937 | Brothers et al. |
| 4,520,526 | A | 6/1985 | Peters |
| 5,331,707 | A | 7/1994 | Irizarry |
| 5,694,658 | A | 12/1997 | Huang et al. |
| 6,003,189 | A | 12/1999 | Falleiros |
| 6,108,849 | A | 8/2000 | Weihrauch |

(Continued)

FOREIGN PATENT DOCUMENTS

| | | | |
|---|---|---|---|
| DE | 36 12 108 | A1 | 10/1987 |
| DE | 38 40 136 | C1 | 5/1990 |

(Continued)

OTHER PUBLICATIONS

International Search Report issued in International Patent Application No. PCT/EP2011/000533 dated Mar. 22, 2011.

*Primary Examiner* — Mark Spisich
(74) *Attorney, Agent, or Firm* — Oliff PLC

(57) ABSTRACT

The oral hygiene device, particularly a toothbrush, has in the neck part, a cavity, which is closed off from the surroundings and in which a snap dome is arranged. This snap dome produces an acoustic warning signal when a limiting bending of the neck part is exceeded as a result of a limiting pressing force with which the head part is pressed, for example, against the teeth and gums is exceeded. On the one hand, this has the effect of protecting the snap dome, usually produced from metal, from corrosion and, on the other hand, the cavity serves as a resonance chamber to amplify the warning signal.

21 Claims, 18 Drawing Sheets

(56) References Cited

U.S. PATENT DOCUMENTS

| | | | |
|---|---|---|---|
| 7,039,984 | B1 | 5/2006 | Watanabe et al. |
| 2001/0047556 | A1 | 12/2001 | Weihrauch |

FOREIGN PATENT DOCUMENTS

| | | | |
|---|---|---|---|
| DE | 93 10 112 | U1 | 6/1994 |
| DE | 195 00 107 | A1 | 7/1996 |
| DE | 195 33 144 | A1 | 3/1997 |
| DE | 102 17 742 | A1 | 11/2003 |
| DE | 20 2006 001 055 | U1 | 4/2006 |
| EP | 0 281 017 | A1 | 9/1988 |
| EP | 0 371 293 | A2 | 6/1990 |
| EP | 0 848 593 | A1 | 6/1998 |
| EP | 1 237 438 | B1 | 9/2002 |
| EP | 1 239 751 | B1 | 9/2002 |
| EP | 1 416 823 | B1 | 5/2004 |
| FR | 2 751 185 | A1 | 1/1998 |
| GB | 2 413 268 | A | 10/2005 |
| GB | 2 413 269 | A | 10/2005 |
| JP | A-7-236519 | | 9/1995 |
| JP | A-2001-299451 | | 10/2001 |
| WO | WO 92/15224 | A1 | 9/1992 |
| WO | WO 96/10934 | A1 | 4/1996 |
| WO | WO 01/21035 | A1 | 3/2001 |
| WO | WO 2004/010822 | A1 | 2/2004 |

ORAL HYGIENE DEVICE, PARTICULARLY A TOOTHBRUSH, AND METHOD FOR THE PRODUCTION THEREOF

The present invention relates to an oral hygiene device.

An oral hygiene device of this type, formed as a toothbrush, is known for example from the printed document DE 93 10 112.0 U1. It has a toothbrush body with a head part and a brush stem adjoining thereto, which is provided with a grip part. Between the head part and the grip part, the brush stem has a snap dome, which is peripherally completely enclosed and held by the toothbrush body and the flat sides of which are exposed to the surroundings. When the pressing force exerted on the head part exceeds a limit value, the dome snaps from its original position into its operating position, thereby producing a clicking noise. When the pressing force is reduced, the snap dome snaps back again into its original position. The acoustic signal in the form of a clicking noise indicates to the user of the toothbrush if he increases the pressing force too much when cleaning the teeth and also indicates to him again when he reduces it to within a favorable range. In the case of this known toothbrush, corrosion and hygiene problems may occur in the region of the snap dome. Furthermore, the snapping motion involves an abrupt deflection, which may be perceived as painful if the snap dome is touched. There is a considerable potential for injury if there are exposed metal edges, for example if it is a defective product. Furthermore, the encapsulation of metal parts, such as for example the snap dome mentioned, can cause changes in the microstructure or the outer form on account of the temperatures required in the injection-molding process. Depending on how and how much this occurs, this may be equivalent to a change in properties, i.e. a change in function. Such a change may also be caused by the forces acting in the injection-molding processes.

The document EP 0 848 593 B discloses a toothbrush with a narrow neck, in which a spring part encapsulated by means of injection molding is integrated. If the pressure on the head part of the toothbrush becomes too great, the neck part of the toothbrush body yields resiliently, so that the head region can give way.

A similar toothbrush is known from the document DE 38 40 136 C. Here, the spring element is surrounded by a casing of an elastomer. In this case, in turn, the temperatures during the injection molding, or the possibly resultant changes in properties, are problematic.

Furthermore, the document WO 2004/010822 A discloses a toothbrush with a sprung element integrated in the handle near the neck part. The sprung element is formed by one or more parallel spring leaves, which are bent about the longitudinal axis of the toothbrush. The spring leaves are embedded in an elastically deformable plastics material. If a limiting pressing force is exceeded, the spring force is reduced abruptly, so that the neck and head parts of the toothbrush pivot backward strongly and the pressing force is thereby reduced. When this happens, it is virtually impossible to perform the cleaning function with too much pressure.

It is an object of the present invention to provide an improved oral hygiene device in which the acoustic warning signal can nevertheless be perceived well, and to propose a method for easily producing such an oral hygiene device.

This object is achieved with an oral hygiene device which has the features of claim 1 and with a method which has the features of claims 12 and 13.

According to the invention, the snap dome also termed snap plate is arranged in a cavity closed off from the surroundings. This protects the snap dome, which is usually produced from metal, from corrosion and from contamination and prevents the possibly corroded snap dome from coming into contact with the surroundings. Moreover, the snap dome does not present any hygiene problems in connection with saliva, toothpaste and water. In addition, the cavity acts as a resonance chamber, so that the clicking noise during the springing of the snap dome is increased and can be heard very well outside the cavity of the toothbrush. This is a major advantage over the solutions with encapsulated snap domes. Moreover, the encapsulation of the snap dome reduces the risk of injury to the user even during improper use.

The acoustic warning signal has the effect of indicating to the user of the oral hygiene device, for example a manual or electric toothbrush or a tongue cleaner, that he is using the oral hygiene device with excessive pressing force, for example with respect to the teeth or the gums. He can, however, continue to use the oral hygiene device, since the springing of the snap dome and the associated emission of the acoustic signal essentially constitute only a warning signal and, as a result, no decisive change in the resilient force occurs. If the user reduces the pressing force to a value below a predetermined limiting pressing force, the snap dome springs back again and thereby likewise emits an acoustic warning signal. The user recognizes that he is again using the oral hygiene device with a permissible pressing force. The acoustic warning signals also have the effect on the user of achieving a learning effect, so that, over time, the oral hygiene device is used consistently with optimum pressing force and the damage, for example to teeth and gums, is reduced.

The snap dome may be designed such that the warning signal when it returns is sounded essentially in response to the same limiting pressing force AG as when it is triggered. In an alternative configurational variant, the limiting pressing force AG for the warning signal is set lower for when it returns than for when it is triggered, in order for example that the user must relieve the pressure on the toothbrush in practice, and consequently consciously establishes that he has used too much pressure. This increases the learning effect.

In a preferred way, the cavity, and consequently the snap dome, is located between the head part and a grip part of the device body. Preferably, it is located approximately midway between the head part and the grip part. However, it is also possible to arrange the cavity and the snap dome in the head part or in the grip part.

In a preferred way, the snap dome is fastened to the device body with its end portions, which are facing the head part or facing away from the head part, or is firmly clamped between the carrying part and the device body. In a middle portion, lying between these end portions that are at a distance from each other, the snap dome is preferably free from contact with the device body with the exception of a possibly present actuating element—see claims 8 and 9—, which assists precise functioning of the oral hygiene device.

In a preferred way, the device body has a recess, which is closed by means of a cover part fitted on the device body. In this manner, the cavity in which the snap dome is arranged is formed and sealed off. The cover part in this case also serves in a preferred way for the fastening of the snap dome to the device body. The holding geometry for the snap dome may in this case be formed on the device body or on the cover part. It should be mentioned at this point that it is also conceivable for the device body itself to close off the cavity completely from the surroundings. The cover part may cover only a region of the neck part, but also protrude into the head part and/or the grip part.

In a further preferred embodiment of the oral hygiene device according to the invention, the cover part is located on the underside, facing away from the user side of the oral hygiene device, i.e. in other words on the side opposite from the application head. This makes it possible to arrange the snap dome outside the bending line of the neck part, near the outer lying surface of the device body or the cover part, which is conducive to precise functioning.

In a further preferred embodiment, the device body has a carrying part with a recess and the cover part is fitted on the carrying part. If the device body is molded from a single plastics component, it consists only of the carrying part made of plastic. Usually, however, device bodies of oral hygiene devices are produced from two or more different plastics components. In this case, the carrying body is understood as meaning that (plastics) component or those (plastics) components that primarily assume(s) the carrying function of the device body. This is obviously a hard component.

In a particularly preferred embodiment, the carrying part has a clearance. This is closed on the side facing away from the cover part, preferably by means of a soft component. This embodiment allows a high and precise elasticity to be imparted to the neck part, so that exact response of the snap dome can be achieved.

Various plastics can be used to realize the invention. The following hard components are possibilities from the area of plastics, by way of example:

styrene polymers such as styrene acrylonitrile (SAN), polystyrene (PS), acrylonitrile butadiene styrene (ABS), styrene methyl methacrylates (SMMA) or styrene butadiene (SB);

polyolefins such as polypropylene (PP) or polyethylene (PE), for example also in the form of high-density polyethylene (HDPE) or low-density polyethylene (LDPE);

polyesters such as polyethylene terephthalate (PET) in the form of acid-modified polyethylene terephthalate (PETA) or glycol-modified polyethylene terephthalate (PETG), polybutadiene terephthalate (PBT), acid-modified polycyclohexane dimethanol terephthalate (PCT-A) or glycol-modified polycyclohexane dimethanol terephthalate (PCT-G);

cellulose derivates such as cellulose acetate (CA), cellulose acetate butyrate (CAB), cellulose propionate (CP), cellulose acetate phthalate (CAP) or cellulose butyrate (CB);

polyamides (PA), such as PA 6.6, PA 6.10 or PA 6.12;

polymethylmethacrylate (PMMA);

polycarbonate (PC);

polyoxymethylene (POM);

polyvinyl chloride (PVC);

polyurethane (PU).

The following soft components are examples from the area of thermoplastic elastomers (TPEs):

thermoplastic polyurethane elastomers (TPE-U) thermoplastic styrene elastomers (TPE-S) such as for example a styrene ethylene butylene styrene copolymer (SEBS) or styrene butadiene styrene copolymer (SBS) thermoplastic polyamide elastomers (TPE-A) thermoplastic polyolefin elastomers (TPE-O) thermoplastic polyester elastomers (TPE-E).

Furthermore, as mentioned, the thermoplastics polyethylene (PE) and polyurethane (PU) may be used as a hard component and as a soft component.

In a particularly preferred way, the carrying part is produced from a hard component. Particularly suitable as the hard component is PP; most preferred is PP with a modulus of elasticity of 1000-2400 N/mm2, preferably 1300 to 1800 N/mm2. A TPE-S is preferably used as the soft component. The Shore A hardnesses of the soft component preferably lie below 90 Shore A. The soft components form a material bond with the hard component by means of overmolding by the two- or multi-component injection-molding process.

In a further preferred embodiment, the cover part has a peripheral frame of a hard component and a soft component part closing the opening of the frame. This embodiment also allows the elasticity of the device body to be increased and set better in the region of the neck part. For the exact setting of the limiting pressing force, the Shore A hardness of the soft material may be set. Furthermore, the flexibility of the neck part can be set by way of the size of the clearance and possibly of the closure part of soft material.

In a further particularly preferred embodiment of the oral hygiene device according to the invention, the carrying part or the cover part has an actuating element, preferably a tongue, which protrudes into the cavity and is intended for contacting the snap dome with its actuating region preferably only when a specific bending of the neck region is reached, and applying an additional force to it in the snapping direction when there is a further increase in the pressing force, so that it springs into the other position as exactly as possible when the limiting pressing force, and consequently the limiting bending, is reached. With this embodiment, very exact functioning can be achieved. Moreover, the tongue does not dampen the clicking noise, and consequently the acoustic warning signal, since the snap dome lifts off from the tongue when it springs over.

In a preferred way, the carrying part has a respective resting surface on the side of the recess facing the head part and on the side of the recess facing away from the head part. During fitting, the snap dome abuts with its end portions lying opposite each other against these resting surfaces. In a preferred way, the carrying part has in the region of the resting surfaces pins protruding in the direction of the cover part. These pins engage in corresponding holes in the snap dome. As a result, an exactly defined position of the snap dome is ensured. Moreover, the snap dome is kept in abutment with the resting surfaces in a preferred way by means of the cover part. Consequently, during bending of the neck part, not only a force in the longitudinal direction but also a torque is exerted on the snap dome.

In a further preferred embodiment, the carrying part is provided with a respective supporting surface on the side of the recess facing the head part and on the side of the recess facing away from the head part. These supporting surfaces act together with the two corresponding end faces of the snap dome facing away from each other. During the bending of the neck part, the supporting surfaces introduce compressive forces directly into the snap dome. It should be mentioned at this point that it is also conceivable to dispense with the resting surfaces transferring a torque to the snap dome and only transfer into the snap dome compressive forces generated by means of supporting surfaces in the longitudinal direction of the device body during bending.

The holding geometry for the snap dome, which is formed by resting surfaces, pins and/or supporting surfaces, may be formed either on the device body, in particular on the carrying part, or else correspondingly on the cover part.

In a particularly preferred way, stop means which limit the bending stress of the snap dome are provided. For example, one stop may be formed by the tongue mentioned further above on the carrying part or cover part, which acts together with a counter-stop on the carrying part or cover part.

Furthermore, it is possible to use a limiting plate, which is fitted directly on the snap dome. The limiting plate may have a thickness of 0.2 mm to 0.8 mm, preferably 0.3 mm to 0.5 mm, and is preferably produced from spring steel (St. 60). The limiting plate may be connected to the snap dome. In this case, the two parts may be connected to each other by spot welding, soldering or brazing, adhesive bonding, riveting or other methods. It is important when connecting the two elements that a relative movement is still at least partially possible between the snap dome and the limiting plate. This means that the connection is preferably established only on one side of the unit, preferably in the region of the end faces. If the limiting plate is to be connected to the snap dome, it may be necessary to provide additional through-holes on the snap dome; this may be necessary, for example, if the two parts are riveted.

The fastening of the two parts preferably takes place in a region around the through-holes on the snap dome, to be precise only on one side of the snap dome.

The oral hygiene devices according to the invention usually have a grip part. This may be formed in one piece on the device body or carrying part, on the side of the neck part that is facing away from the head part. However, it is also possible for the grip part to be an independent part which can be connected to the neck part; for example, the neck part can be fitted onto or into the grip part or screwed onto it.

Furthermore, it is also possible for the head part to carry a bearing element for an exchangeable head, as is known from exchangeable head toothbrushes. It is also conceivable for the bearing element to be intended for the rotatable mounting of a tooth cleaning head or a tongue cleaning head, as is generally known in particular for electric toothbrushes. In this manner, only the application head, for example a brush head, could be exchanged. The snap mechanism would in this way have a lifetime that could last longer than a number of application heads.

Particularly preferred methods for producing an oral hygiene device according to the invention are specified in the further claims.

The invention is explained on the basis of an oral hygiene device formed as a toothbrush, which is represented in the drawing, in which, purely schematically:

Figure 1:
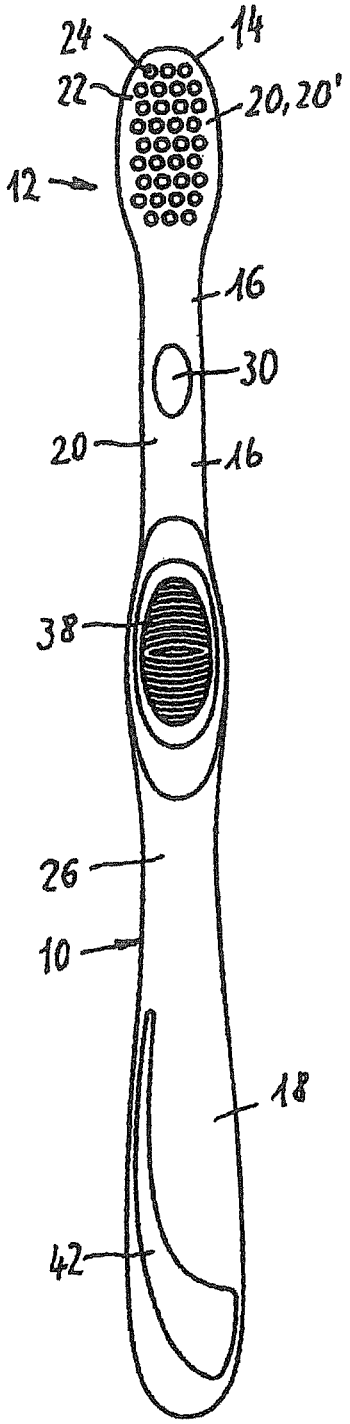
FIG. 1 shows the upper side, corresponding to a user side, of a toothbrush body of a toothbrush according to the invention.

The present invention relates to an oral hygiene device. This includes manual and electric toothbrushes and tongue cleaners. The invention is explained on the basis of a manual toothbrush according to the invention that is represented in the drawing. Other oral hygiene devices according to the invention are formed correspondingly. For example, a tongue cleaner or an interdental cleaner (dental floss, screwed-in brush, toothpick, etc.) may take the place of a bristle-carrying toothbrush head part.

Figure 2:
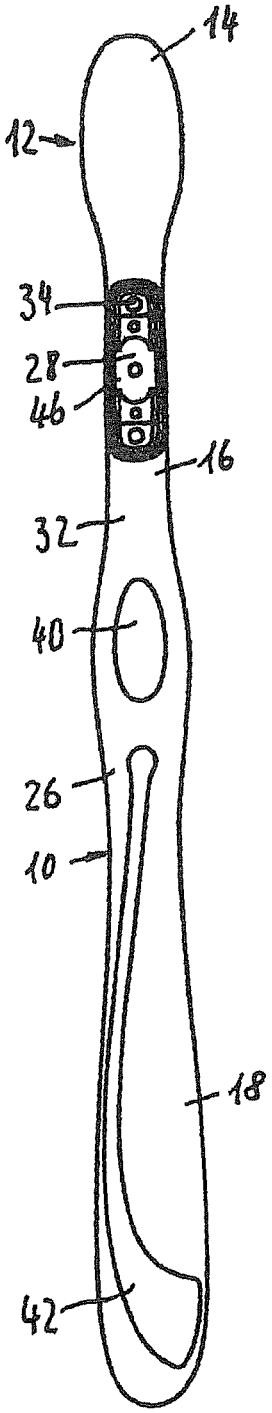
FIG. 2 shows the underside of the toothbrush body as shown in FIG. 1, with a recess in the neck part for forming a cavity and for receiving a snap dome.
Figure 3:
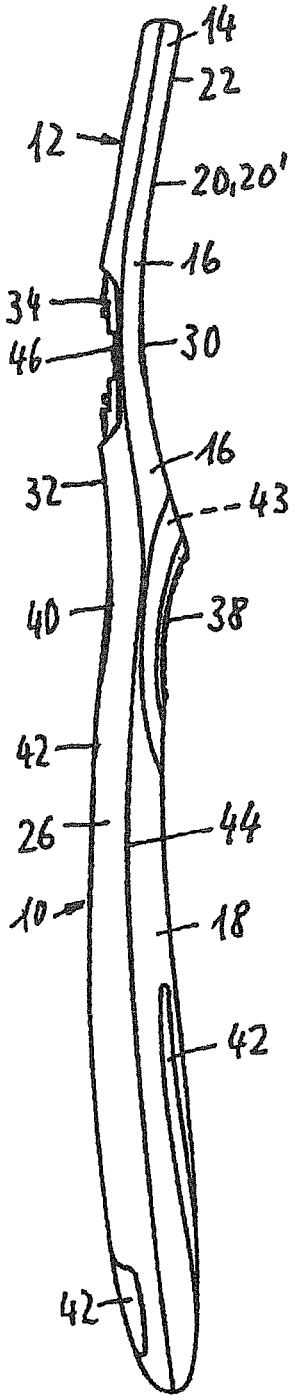
FIG. 3 shows the toothbrush body as shown in FIGS. 1 and 2 in side view.

FIGS. 1 to 3 show a device body 10 of an oral hygiene device, to be specific of a toothbrush 12 formed as a manual toothbrush. The device body 10 has a head part 14, a neck part 16, carrying the latter and adjoining thereto in one piece, and a grip part 18, integrally adjoining the neck part 16.

The head part 14 is provided on its upper side 20 with a bristle carrying surface 22, determining a use side 20'. From it, bristle receiving holes 24, formed in the manner of blind holes, run into the head part 14. Tufts of bristles are inserted into the bristle receiving holes 24 in a known way by means of so-called "conventional punching with anchor plates". It goes without saying that other methods of providing bristles, such as AFT, IAP or IMT, may also be used for inserting the bristles.

The head part 14 is formed by a carrying part 26. The carrying part 26 extends uninterruptedly from the free end of the head part 14 to the free end of the grip part 18 and, in the exemplary embodiment shown, is produced from a hard component by means of injection molding.

Approximately midway between the grip part 18 and the head part 14 there is formed—seen in a view from below—on the carrying part 26 on the longitudinal axis in the neck part 16 a clearance 28, which runs transversely in relation to the longitudinal axis and is closed on the upper side 20 of the device body 10 by means of a closure part 30, in the present case of a soft component molded on by the injection-molding process. On the underside 32, facing away from the upper side 20, of the device body 10, the clearance 28 is open to the surroundings and the holding geometry 34 for a snap dome 36 is formed on the carrying part 26, see FIGS. 8 to 10.

This holding geometry 34 for the snap dome 36 is preferably arranged—seen in a view from below—on the longitudinal axis and the snap dome 36 is in this way preferably arranged symmetrically in the toothbrush 12. The optimum function, that is to say the triggering of the warning signal when there is a predetermined limiting pressing force AG, is thereby triggered when there is a force perpendicular to the bristle carrying surface 22. When there are forces that act obliquely on the bristle carrying surface 22, the component acting perpendicularly in relation to the bristle carrying surface 22 is decisive for the triggering of the function.

The clearance 28 and the closure part 30 constitute a possible means for setting the elasticity of the device body 10 or for the mechanism. Possibilities for variation are the form; the cross section may be shaped as an ellipse, a circle or in any way desired, as well as the width; it is between 2 mm and 12 mm, preferably between 4 mm and 6 mm, and the length; it is between 4 mm and 17 mm, preferably between 8 mm and 12 mm. The ratio of length to width is preferably 1:5 to 1:1; the clearance 28 and the closure part 30 are preferably longer than they are wide. A further factor is the material or the Shore A hardness of the soft material; softer materials give a lower limiting pressing force AG.

In the end region of the grip part 18 on the neck part side, the carrying part 26 has a hollow-like depression on the upper side 20 and on the underside 32. The two depressions are preferably connected to each other by way of a connecting channel; also see FIG. 19. Molded on the depression on the upper side 20 is a thumb rest 38 and on the depression on the underside 32 an index finger rest 40, preferably of a soft component. This may be the same soft component as in the case of the closure part 30. To produce such separate regions of the same component, the production process by means of a cascade is suitable; this involves an injection-molding unit feeding a number of injection points on the product. In an alternative configurational variant, these regions in the product are connected to one another and are fed by means of a single injection point.

Furthermore, on the upper side 20 between the thumb rest 38 and the free end of the grip part 18 and on the underside 32 between the index finger rest 40 and the free end of the grip part, the grip part 18 has elongate depressions, in the exemplary embodiment shown ornamental depressions, injection-molded in which there is a further soft component 42, which is exposed in the direction of the surroundings and consequently improves the feel. The further soft component 42 may be the same soft component as in the case of the thumb rest 38 and the index finger rest 40 or the closure part 30.

Figure 19:
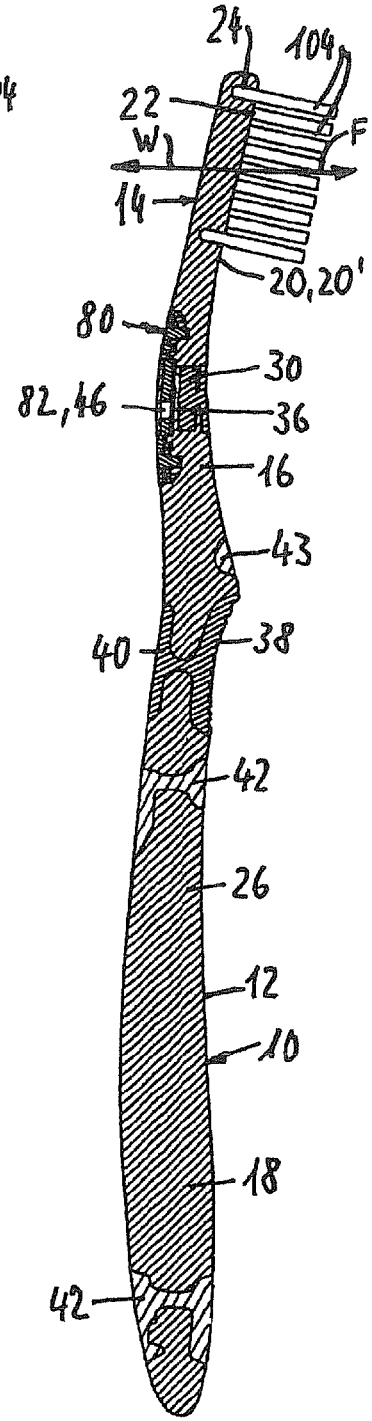
FIG. 19 shows a longitudinal section through the toothbrush as shown in FIGS. 17 and 18.

Furthermore, the carrying part 26 has a groove 43, which runs around the thumb rest 38 at a small distance from it and is also filled with the further soft component 42. As FIG. 19 shows, this groove 43 is connected by means of a further connecting channel to the depression on the underside 32 and the latter is for its part connected, in the free end region of the grip part 18, by way of an additional connecting channel to the depression on the upper side 20. This makes it possible for the further soft component 42 to be injected into the depressions and the groove 43 by way of a single injection point.

Furthermore, the mold parting line 44 of the injection mold for producing the device body 10 can be seen in FIG. 3. Seen in side view, it runs approximately centrally between the upper side 20 and the underside 32. Furthermore, this FIG. 3 also shows that, in the exemplary embodiment shown, the opening of the clearance 28 on the underside 32 extends almost up to the mold parting line 44 and the holding geometry 34 is offset with respect to the mold parting line 44 toward the underside 32.

Alternatively, the clearance 28 may extend, at least in a partial region, exactly up to or beyond the mold parting line 44. The elasticity, and consequently the limiting pressing force AG, of the toothbrush can be set by means of the depth of the clearance 28.

It should be mentioned at this point that it is also possible to produce the device body 10 from a single component, preferably a hard component, by the injection-molding process. In this case, the device body 10 has only the carrying part 26 and is provided in the neck part 16 with a recess 46. In the exemplary embodiment shown, this is formed by the clearance 28 closed by means of the closure part 30.

The materials that can be used in the injection-molding process can be taken from the introduction.

FIGS. 4 to 7 show the portion of the neck part 16 with the clearance 28 or the recess 46 in various representations and enlarged in comparison with FIGS. 1 to 3.

Seen in a view from below, the bottom of the recess 46 (i.e. the underside opening of the clearance 28 or of the recess 46) is of a virtually rectangular form with rounded corners. It has a circumferentially uninterruptedly encircling receiving groove 48, which is formed on the carrying part 26; see FIGS. 6 and 7 in particular. On the radially inner lying side of the receiving groove 48 there is an uninterruptedly encircling sealing element 50, preferably of a soft component. In the exemplary embodiment shown, the sealing element 50 is molded onto the radially inner lying side wall of the receiving groove 48 by the two-component injection-molding process. The soft component forms a material bond. In a particularly preferred way, the material of the sealing element 50 is the same material as in the case of the closure part 30, so that during the injection molding it can also pass through the sprue 52, for example by way of a connecting web 54 or other connections, into the corresponding cavity of the injection mold and into the receiving groove 48.

By means of cascade injection molding, the sealing element 50 can also be produced together with other soft components of the device body 10. Alternatively, the sealing element 50 may also be a fitted part, which is produced separately and subsequently inserted into the device body 10.

It goes without saying that the sealing element 50 may also be molded or fitted on a cover part 80, which is described further below, as an extension of a soft component part 86.

The holding geometry 34 has a respective resting surface 56 on the side facing the head part 14 and on the side facing away from the head part 14, that is to say facing the grip part 18. The two resting surfaces are at a distance from each other, in the longitudinal direction of the device body 10, and in the exemplary embodiment shown lie in one plane; this is in the state of rest and when the neck part 16 is not bent as a result of a pressing force on the head part 14.

With respect to the underside 32, the resting surfaces 56 lie at a distance of 0.5 mm to 3 mm, preferably 0.8 mm to 2 mm, in the device body 10 and are preferably arranged nearer the underside 32 than the upper side 20.

Approximately in the middle of the resting surfaces 56, the holding geometry 34 has a respective pin 58, which is formed on the device body 10 or the carrying part 26 and protrudes in the direction of the underside 32 beyond the resting surface 56 concerned. In a preferred way, the pins 58 are formed such that they taper toward the free end.

The resting surfaces 56 have a maximum length of 2 mm to 8 mm, preferably of 4 mm to 6 mm, and a maximum width of 3 mm to 9 mm, preferably of 5 mm to 7 mm. The geometrical form of the resting surfaces 56 is free, but preferably adapted to the circumferential contour of the snap dome 36. The size of the resting surface 56 in comparison with the snap dome 36 is the same, larger or smaller; preferably, the resting surface 56 is designed with a small oversize in comparison with the snap dome 36. The resting surface 56 is preferably made from a hard component, but it may also be made only from a soft component or from a combination of a hard component and a soft component. The configuration of the resting surface 56 can influence the volume of the acoustic signal, the clicking behavior or else the welding of the cover part 80 to the device body 10.

In terms of form, the pins 58 are preferably of a circular or elliptical shape or are formed as a rectangle with rounded edges. In addition, further forms are possible, such as for example an n-gon. In the case of a round configuration, the pins 58 have a diameter of 0.5 mm to 5 mm, preferably of 0.9 mm to 2 mm. In the case of a more rectangular configuration, they have a length (in the transverse direction of the snap dome 36) of 1.8 mm to 3 mm, preferably 2.1 mm to 2.7 mm, with a width (in the longitudinal direction of the snap dome 36) of 0.5 mm to 2.5 mm, preferably of 1.5 mm to 2.1 mm. They are configured in two diameter stages, tapering toward the free end. This serves for the centering and welding. Starting from the resting surface 56, the pin has a height of 2 mm to 10 mm, preferably of 4 mm to 6 mm.

Furthermore, the two resting surfaces 56 are delimited by supporting surfaces 60, which preferably run at right angles to the resting surfaces 56 and at right angles to the longitudinal direction of the device body 10. These supporting surfaces 60 are likewise formed on the carrying part 26.

Between the supporting surfaces 60 or the resting surfaces 56 and the receiving groove 48, the carrying part 26 also has circular-cylindrical blind holes 62, which are open in the direction of the underside 32 and are formed as stepped in diameter, forming a stop shoulder 64.

Figure 6:
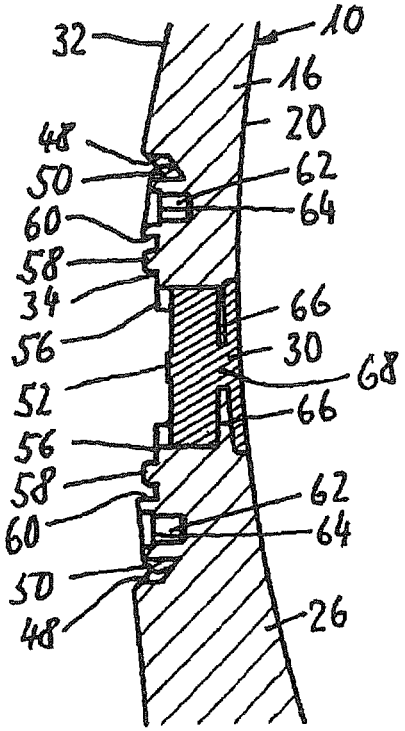
FIG. 6 shows a longitudinal section through the portion of the neck part that is shown in FIGS. 4 and 5.
Figure 7:
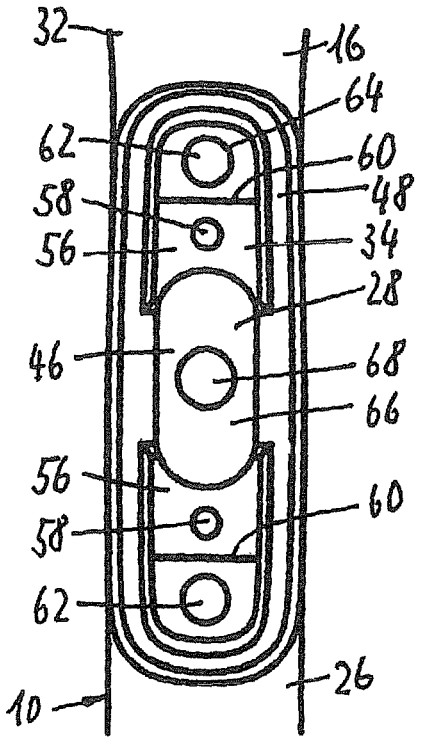
FIG. 7 shows in the same representation as FIG. 4 the portion shown there of the neck part, although only the hard component is represented.

As revealed in particular by FIGS. 6 and 7, the carrying part 26 has, between the holding geometry 34 and the upper side 20, preferably near the latter, a film-like separating part 66, which passes through the clearance 28 and has a soft component clearance 68. This separating part 66 is received in the closure part 30.

The thickness of the separating part 66 influences the elasticity, and can be used to set the limiting pressing force AG of the toothbrush. It is possible to configure the carrying part 26 in this region such that the separating part 66 has a significant extent in the direction of the underside 32. This means that the soft component shown in FIG. 6 can be replaced by a hard component on the underside 32 of the closure part 30 apart from an extension of the soft component clearance or a bar with the width of the soft component clearance 68 and the length and width of the closure part 30 in the direction of the underside 32. As a result, the device body 10 is significantly more stable and less bendable in the region of the recess 46.

It is also possible to configure the region of the closure part 30 such that the film-like separating part is not covered, or only covered very thinly, with soft material on the underside 32 of the device body. In this case it is possible to configure the sprue 52 as a cylinder, which is located in the extension of the soft component clearance 68.

The film-like separating part 66 may also be configured such that the soft component clearance 68 is made very large in terms of its dimensions. In this case, the film-like separating part 66 may be reduced very greatly, measured in the clearance 28 on the underside 32, so that the radially encircling periphery can be reduced to 0.2 mm to 0.8 mm. This makes the contour of the soft component clearance 68 become oval. However, it is also possible to make it have a circular form. The clearance has in this case a diameter of 1.2 mm to 4 mm.

Among its configurational variants, the sprue 52 may be formed in length such that it ends between 0.1 mm and 0.8 mm, preferably between 0.25 mm and 0.5 mm, below the resting surface 56. This allows the effect to be achieved in all the configurational variants with soft material that the deflection of the snap dome 36 after the change in state is limited by the sprue 52. After the change in state, a certain further overbending caused by too much pressure is followed by the snap dome 36 being assisted in assuming a convexity 72.

Figure 8:
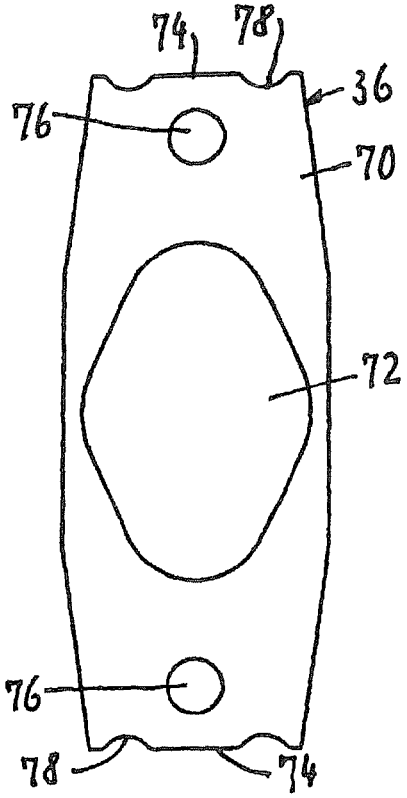
FIG. 8 shows a snap dome in a view from below.
Figure 9:
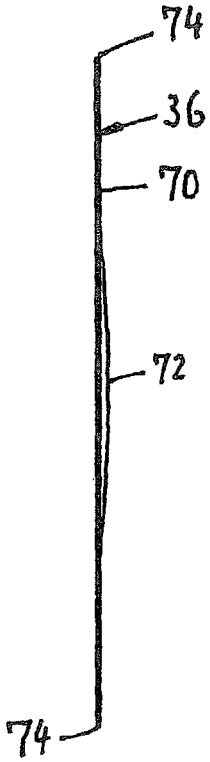
FIG. 9 shows the snap dome as shown in FIG. 8 in side view.
Figure 10:
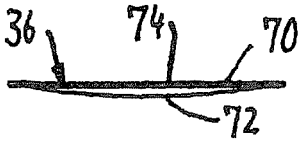
FIG. 10 shows the snap dome as shown in FIGS. 8 and 9 in a view of the short side.
Figure 11:
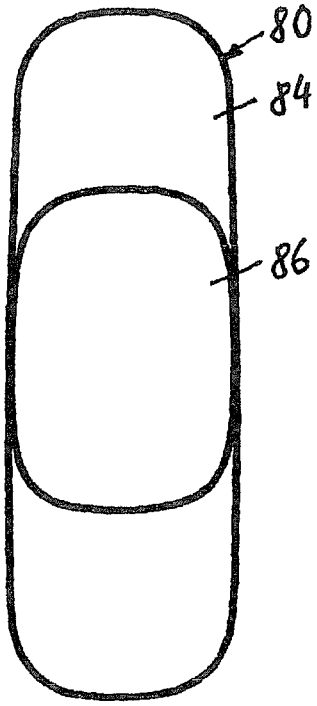
FIG. 11 shows a cover element in a view from below.
Figure 12:
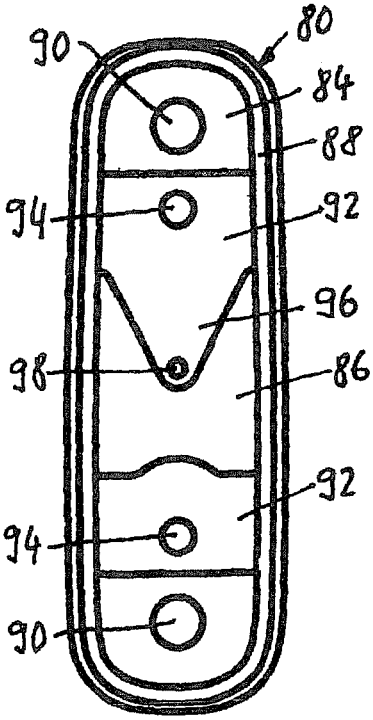
FIG. 12 shows the cover element as shown in FIG. 11 in plan view.
Figure 13:
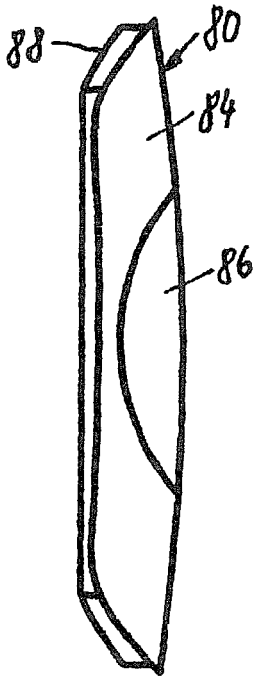
FIG. 13 shows the cover element as shown in FIGS. 11 and 12 in side view.

FIGS. 8 to 10 show a preferred embodiment of the snap dome 36, as provided for insertion into the holding geometry 34 of the recess 46. It consists of an approximately rectangular spring steel plate 70, in which the convexity 72 is formed in a middle region and protrudes from one of the flat sides of the planar spring steel plate 70. Between the two end faces 74, at a distance from each other in the longitudinal direction of the spring steel plate 70, and the convexity 72, the spring steel plate 70 has a respective through-hole 76. These through-holes 76 are intended for being passed through by the pins 58 when the snap dome 36 is fitted in the device body 10; compare FIGS. 4 to 7.

With a round configuration of the pin 58, these through-holes 76 have for this purpose a diameter of 0.5 mm to 5 mm, preferably of 0.9 mm to 2 mm, and, with a rectangular configuration of the pin, a length (in the transverse direction) of 1.8 mm to 3 mm, preferably 2.1 mm to 2.7 mm, with a width (in the longitudinal direction) of 0.5 mm to 2.5 mm, preferably of 1.5 mm to 2.1 mm, made to match the diameter and the form of the pin 58. The position of the through-holes 76 (with respect to the center point/center of gravity) of the respective end face 74 of the snap dome 36 is 1 mm to 5 mm, preferably 1.5 mm to 3.5 mm. In the transverse direction, they are preferably arranged on the longitudinal axis or symmetrically in relation to the longitudinal axis.

Furthermore, the end faces 74 are intended for acting together with the supporting surfaces 60 in the fitted state, in that they abut against them or come into abutment with them after a slight bending of the device body 10. They act together particularly under pressure. The end faces 74 may have indentations 78, as FIG. 8 reveals. These indentations 78 may serve along with the pins 58 as additional centering elements or be formed as independent cenetring elements if the pins 58 are omitted. If pins 58 are used as centering elements, the indentations 78 may also be omitted, i.e. the end faces 74 can be formed straight right across.

In the exemplary embodiment shown, the convexity 72 has a rhomboidal basic form with rounded corners. However, it is also conceivable for the convexity 72 to have a circular or some other basic form.

The dimensions of the convexity are between 3 mm and 12 mm in length, preferably between 6 mm and 9 mm. The width of the convexity is between 2 mm and 8 mm, preferably between 3.5 mm and 6.5 mm. The height of the convexity is between 0.1 mm and 0.5 mm, preferably between 0.15 mm and 0.35 mm. The position of the convexity is preferably symmetrical in relation to the longitudinal axis and the transverse axis of the spring steel plate 70; nevertheless, a different arrangement is possible.

It is possible as a configurational variant to provide the snap dome 36 with detents, which is not shown in the figures. These detents are there to dig themselves firmly into the plastic of the resting surface 56 when they are pressed into it during fitting. This is intended to avoid the snap dome 36 acting like a razor blade and shearing/cutting off the pins 5 as a result of the loading occurring when it performs its function during use. Furthermore, a snap dome configured in this way has the effect of increasing the resistance under loading counter to the direction of use. The detents may be formed in various ways from the sheet metal of the snap dome. On the one hand, they may be formed as elements bent at right angles on the end face 74 of the snap dome, on the other hand they may protrude out of the plane of the snap dome 36 in the region of the resting surface 56 and in this way impinge perpendicularly on the resting surface 56. In this case it is possible for the detents to be formed directly in the region of the through-holes 76 of the pins 58. There is just formed a recess, which on the one hand forms the through-hole 76 and from which on the other hand the detent protrudes. The detent protrudes from the underside of the snap dome 36 by 0.1 mm to 0.8 mm, preferably 0.3 mm to 0.6 mm.

Considered on its own, the snap dome 36 is an element with a state of rest and a triggered state. The state of rest is the unloaded state, if the snap dome 36 is considered on its own. If it is not exposed to any external effect, it does not produce any other state, and so it is stable. The triggered state is when the snap dome 36 is bent and the acoustic signal is triggered. Considered on its own, the snap dome 36 has the tendency in the triggered state to return to the state of rest of its own accord, without being exposed to any external effect, as soon as the effect that brought it from the state of rest into the triggered state is no longer present.

Figure 20:
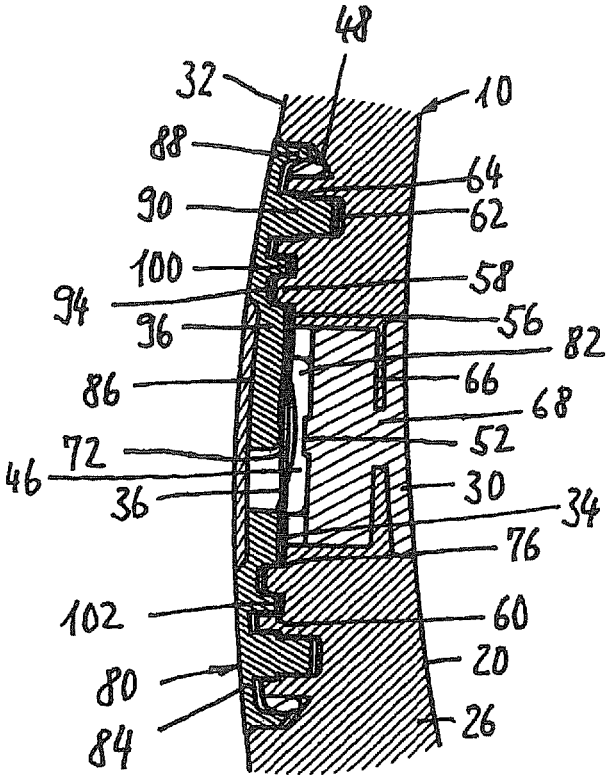
FIG. 20 shows a longitudinal section through the portion of the neck part as shown in FIG. 6, but in the ready-fitted state corresponding to FIG. 19.

FIGS. 11 to 15 show a cover part 80 for closing the clearance 28 or the recess 46 on the underside 32 of the device body 10 with respect to the surroundings, so that a cavity 82 that is closed in a preferably sealing manner with respect to the surroundings is formed in the neck part 16; compare in this respect FIGS. 19 and 20.

The cover part 80 has an encircling frame 84, preferably of a hard component. In the exemplary embodiment shown, the opening formed by the frame 84 is closed by means of a molded-on soft component part 86. It is also conceivable for the cover part 80 to be produced from a single component, preferably a hard component. The hard component is preferably the same material as in the case of the carrying part 26, in order that the welding functions optimally.

The material that is preferably used is polypropylene. The molded-on soft component part 86 forms a kind of membrane, at least partly without the assistance of hard material. In this way it is possible to set the elasticity, and consequently the limiting pressing force AG, of the toothbrush by the geometrical configuration of this surface area and with the aid of the variation in layer thickness.

An alternative configurational variant would be to form the cover part 80 only by the frame 84 and to leave the soft component part 86 open. After the fitting of the snap dome 36 and the welding of the cover part 80 to the device body 10, a sealing element, for example in the form of a tube or shrink-fit tube, could then be brought over the opening to close it.

Figure 4:
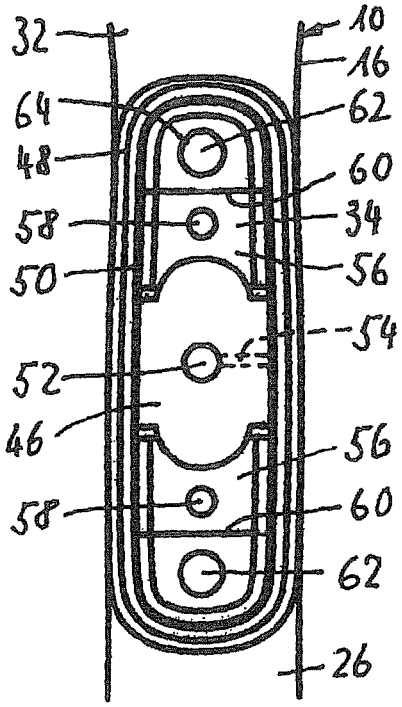
FIG. 4 shows part of the neck part with the recess in a view from below and enlarged in comparison with FIG. 2.
Figure 5:
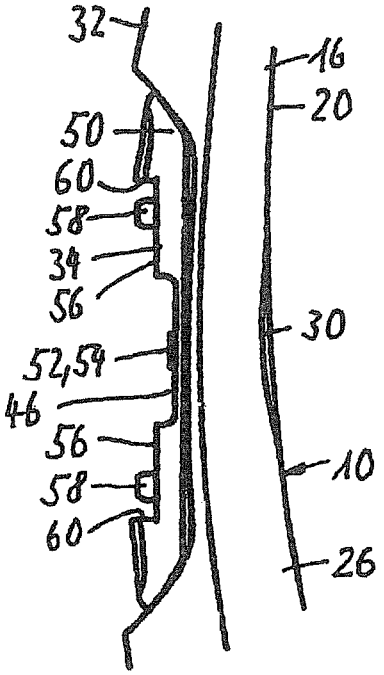
FIG. 5 shows a portion of the neck part with the recess in side view and enlarged in comparison with FIG. 3.

The frame 84 has on its upper side, which faces the device body 10 or the carrying part 26, a protruding and preferably uninterruptedly encircling bead 88, which is intended for the purpose of engaging in the receiving groove 48 when the cover part 80 is fitted on the device body 10; compare FIGS. 4 and 6 in particular. In a preferred way, the bead 88 has a cross section that is pointed toward the free end. This form may serve as an energy concentrator during the ultrasonic welding of the bead 88, and consequently of the cover part 80, to the device body 10 or the carrying part 26. This energy concentrator ensures the connection of the cover part 80 and the device body 10 or the carrying part 26 during welding, for which purpose it is melted.

Fastening pins 90 also protrude from the frame 84, are formed to match the blind holes 62 and are intended for the purpose of coming into engagement with the blind holes 62 during the fitting of the cover part 80. The fastening pins 90 are preferably not of the same length on the head part 14 side and on the grip part 16 side. The fastening pin 90 on the head part 14 side is preferably longer than that on the grip part 16 side. Nevertheless, the reverse configuration is also possible, as is the configuration with fastening pins 90 of the same length. Furthermore, abutting surfaces 92 corresponding to the resting surfaces 56 are formed on the frame 84. In the unloaded state, the abutting surfaces 92 are arranged analogously to the resting surfaces 56 in one plane. Formed in these abutting surfaces 92 is a respective receiving blind hole 94, in which the assigned pin 58 engages during the fitting of the cover part 80; compare FIGS. 4 to 7.

Furthermore, in the case of the preferred embodiment shown of the cover part 80, a tongue 96 protrudes from the portion forming the abutting surface 92 on the head part side, in the direction of the other abutting surface 92, into the middle of the cover part 80. Seen in plan view, the tongue 96 is triangularly formed, but other forms are also possible. For example, a semicircular kind of geometry may serve as the tongue 96; what is important in the case of all geometries is that they taper in the direction of the free end or of an actuating lug 98. The length of the tongue 96 from its point of attachment is 2 mm to 10 mm, preferably 3 mm to 6 mm, and its width (at the point of attachment) is 2 mm to 10 mm, preferably 3.5 mm to 6.5 mm.

Furthermore, the tongue 96 has in the free end region the protruding actuating lug 98. The actuating lug 98 is preferably an element with a circular, elliptical or n-gonal base, from which a cone or a pyramid rises up. The width and the length of the actuating lug 98 is between 0.2 mm and 1 mm, preferably between 0.4 mm and 0.6 mm. The height of the element is between 0.1 mm and 1.2 mm, preferably 0.3 mm to 0.8 mm.

Figure 14:
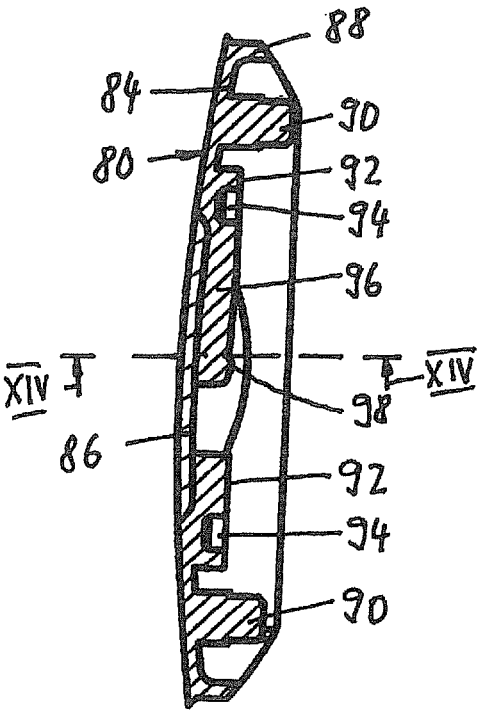
FIG. 14 shows a longitudinal section through the cover element as shown in FIGS. 11 to 13.
Figure 15:
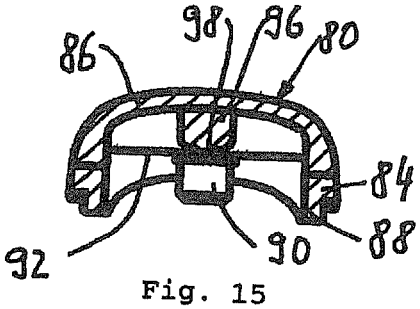
FIG. 15 shows a cross section through the cover element along the line XIV-XIV of FIG. 14.

As FIGS. 14 and 15 reveal in particular, the tongue 96 may be firmly connected at least partially to the soft component part 86 as a result of the injection-molding process. As can be seen in FIG. 14, the tongue 96 rises up in the direction of its free end from the plane that is formed by the abutting surfaces 92. The reason for this is that the tongue 96 or the actuating lug 98 must not contact the snap dome 36 in the fitted state before and during the welding. The welding with ultrasound is accompanied by vibrations on the snap dome 36, which would be accompanied by melting of the tongue 96 or of the actuating lug 98 if there were contact with the tongue 96 or the associated actuating lug 98.

Figure 16:
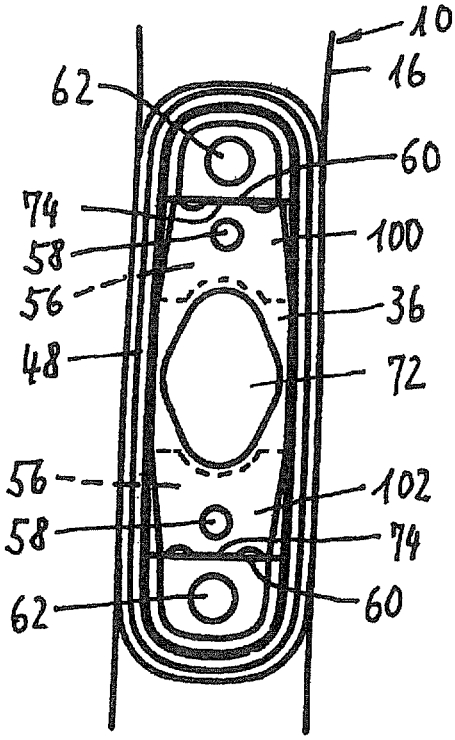
FIG. 16 shows in the same representation as FIG. 4 the portion concerned of the neck part with a snap dome as shown in FIGS. 8 to 10 inserted into the recess.

The cover part 80 has a length of 20 mm to 30 mm, preferably 23 mm to 27 mm. The width is between 5 mm and 11 mm, preferably 7 mm to 9 mm. The soft component part 86 has a thickness of at most 1 mm, preferably at most 0.8 mm. FIG. 16 shows in a view from below the recess 46 in the neck part 16 with the snap dome 36 inserted in the holding geometry 34, as shown in FIGS. 8 to 10. The snap dome 36 abuts with its first end portion 100, facing the head part 14—between the convexity 72 and the end face 74 on this side—flat against the corresponding resting surface 56 and with a second end portion 102, facing away from the head part 14 and consequently facing the grip part 18—between the convexity 72 and the end face 74 on this side—flat against the corresponding resting surface 56. The pins 58 penetrate through the through-holes 76; in a preferred way, these pins provisionally secure the inserted snap dome 36 by means of frictional engagement. Furthermore, FIG. 16 reveals that the snap dome 36 abuts with its end faces 74 against the supporting surfaces 60 concerned. Furthermore, it can be clearly seen by a comparison of FIGS. 4 and 16 or by considering FIG. 20 that the convexity 72 is exposed; i.e. the middle portion having the convexity 72 and arranged between the first end portion 100 and the second end portion 102 is exposed and does not abut against the device body 10 or the carrying part 26.

Figure 17:
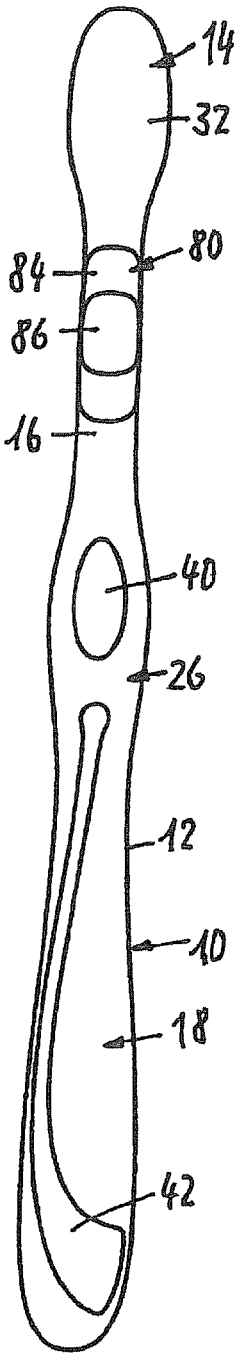
FIG. 17 shows a toothbrush according to the invention in a view from below, with the toothbrush body of which the recess for forming a cavity is closed by means of the cover element as shown in FIGS. 12 to 14.
Figure 18:
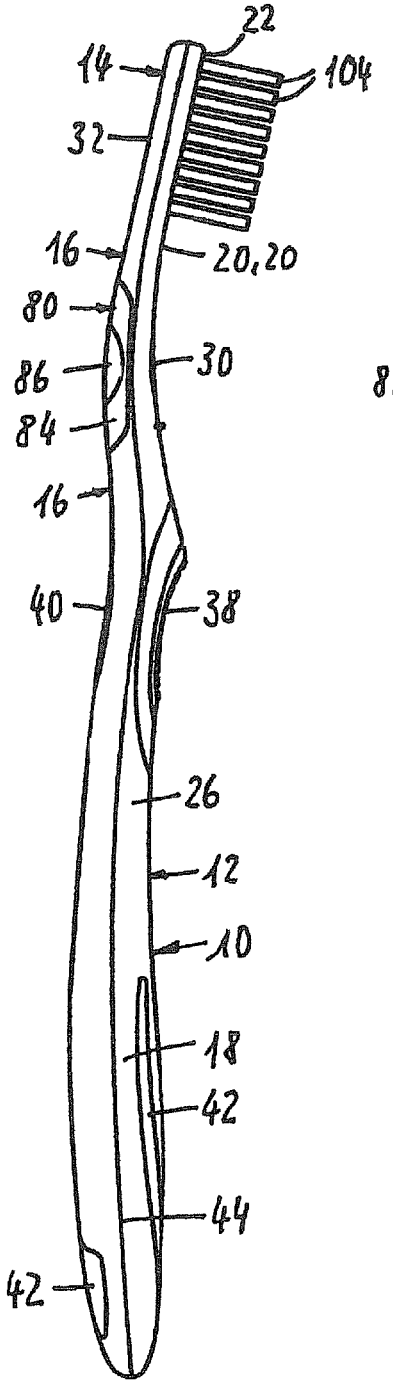
FIG. 18 shows the toothbrush according to the invention as shown in FIG. 17 in side view.

FIGS. 17 to 19 show a toothbrush 12 according to the invention, with a device body 10 as shown in FIGS. 1 to 3, a snap dome 36 inserted into the recess 46 and the cover part 80 fitted in a sealing manner on the device body 10 or the carrying part 26. Furthermore, the tufts of bristles 104 inserted into the bristle receiving holes 24 are shown.

FIG. 20 shows the portion of the neck part 16 with the recess 46, the snap dome 36 inserted into the neck geometry 34 and the cover part 80 fitted on the carrying part 26, enlarged in comparison with FIG. 19. The reference signs of the individual parts correspond to the reference signs used further above. The snap dome 36 is held with its first end portion 100 and second end portion 102 firmly clamped between the resting surfaces 56 and the corresponding abutting surfaces 92. The pins 58 passing through the through-holes 76 engage in the receiving blind holes 94 of the cover part 80.

Correspondingly, the fastening pins 90 of the cover part 80 engage in the blind holes 62 of the carrying part 26, so that the stop shoulders 64 abut against the counter-stop shoulders of the fastening pins 90.

Furthermore, in the fitted state, the bead 88 of the cover part 80 is arranged in the receiving groove 48 of the carrying part 26, the sealing element 50 that is molded on the carrying part 26 abutting in a sealing manner against the radially inner lying side wall of the bead 88. The sealing achieved in this way closes off the cavity 82 completely, even if the material connection, i.e. the welding, is only provided in the region of the fastening pins 90.

It should be mentioned at this point that, in the state of rest shown, the convexity 72 of the snap dome 36 is facing in the direction of the underside 32 and the tongue 96 is at a slight distance from the convexity 72. The other kind of arrangement of the convexity 72 is possible, but requires adaptations to the mechanism or the arrangement thereof. In all the configurational variants, the convexity 72 is preferably directed in the direction of the cover part 80.

In a preferred way, the geometry of the recess 46 and the geometry of the cover part 80, in particular the frame 84 thereof, are made to match each other in such a way that, when the cover part 80 is fitted on the device body 10 or the carrying part 26, a clamping connection is established between these parts. This clamping connection may take place, for example, by a frictional engagement between the fastening pins 90 and the corresponding blind holes 62. However, it is also conceivable for the clamping connection to take place additionally or alternatively between the bead 88 and the sealing element 50. Furthermore, it is conceivable to form the clamping connection additionally or alternatively by frictional engagement of the pins 58 with the receiving blind holes 94.

In a preferred way, the cover part 80 is fastened to the device body 10 by means of ultrasonic welding. In a preferred way, the fastening pins 90 in the blind holes 62 are firmly welded to the device body 10 by means of spot welding. In a preferred way, the stop shoulder 64 and the counter-shoulders formed on the fastening pins serve for this purpose. In this case, the geometrical combination of the counter-shoulders and the stop shoulders 64 acts as an energy concentrator. However, it is also conceivable to weld the bead 88 over its entire length to the device body 10 in combination with or as an alternative to these spot weldings by means of a three-dimensional ultrasonic welding, as already described above.

In any event, in the finished state of the toothbrush 12 or of the oral hygiene device, the neck part 16 has the cavity 82, in which the snap dome 36 is arranged.

On account of its small material thickness, the snap dome 36 is a relatively sensitive element in terms of its mechanism. Overloading, whether tensile or compressive, may impair the snapping function. The problem here is that the users want to test the mechanism, and in this way unintentionally impair the snapping function by overbending the snap dome. Solutions to remedy this problem are shown in FIGS. 21 and 22.

Figure 21:
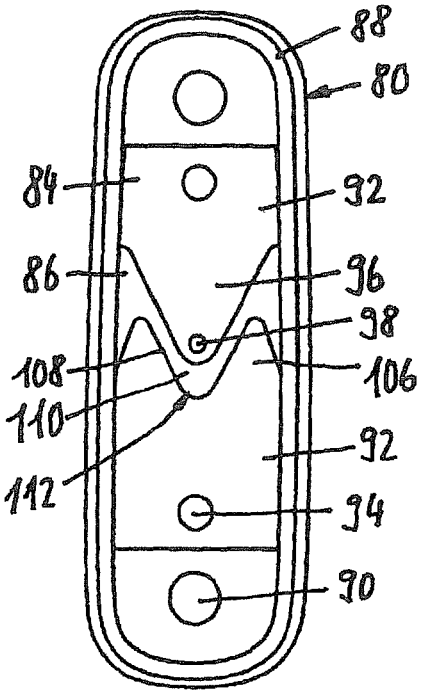
FIG. 21 shows a further embodiment of the cover element in plan view, with stop means for preventing overstressing of the snap dome.
Figure 22:
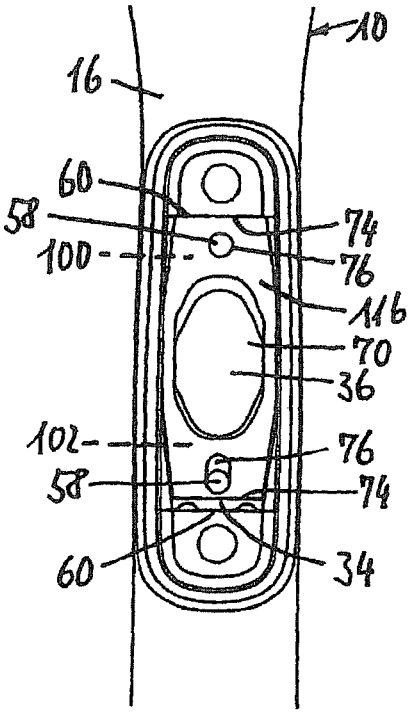
FIG. 22 shows in a view from below the portion of the neck part with a limiting plate placed over the snap dome to prevent overstressing of the snap dome.

FIG. 21 shows a further preferred embodiment of the cover part 80 in plan view. This cover part is configured in exactly the same way as represented in FIGS. 11 to 15 and described further above. The only difference is that a stop tongue 106 protrudes from the abutting surface 92 facing away from the head part 14, in the direction of the tongue 96. The front side 108, facing the tongue 96, is formed in a preferred way to match the free end region of the tongue 96, so that between the tongue 96 and the stop tongue 106 there is, in the state of rest of the device body 10, a gap 110, of constant width measured in the longitudinal direction of the device body 10. Acting together with the tongue 96, the stop tongue 106 forms stop means 112, in order to limit the bending stress of the snap dome 36 during use of the oral hygiene device, or of the toothbrush.

In this case, acting together with the tongue 96, the stop tongue 106 limits the compressive stress; the loading of the snap dome 36 under tensile stress is not limited in this way.

The gap 110 is 0.5 mm to 2 mm, preferably 0.8 to 1.5 mm, wide. The gap may be adjoined laterally by gap connecting portions, in the region of which the distance between the tongue 96 and the stop tongue 106 is greater than the width of the gap 110.

In principle, the bending stress of the snap dome 36 should be limited, or at least reduced, by a corresponding configuration of the cover part.

The stop tongue 106 may also be formed such that, like the tongue 96, it is laterally not connected to the frame 84 and only forms the counter-stop in the region of the tip of the tongue 96. In this case, the gap 110 that is shown in FIG. 21 continues on the stop tongue 106 side in the direction of the end on the short side of the cover part 80.

FIG. 22 shows a further possible configuration of the holding geometry 34 and of the snap dome 36 in a view from below. In this case, placed on the snap dome 36 described further above and shown in FIGS. 8 to 10 is a limiting plate 116, which is intended to protect the snap dome 36 from overloading. Comparison between FIGS. 16 and 22 shows the difference well. The limiting plate 116 is placed directly on the snap dome 36; this limiting plate 116 is configured in a way similar to a frame. The outline follows the outer contour of the snap dome 36 and, in the interior, a recess is made in the region of the convexity of the snap dome 36. When the snap dome 36 and the limiting plate 116 are fitted, i.e. placed one over the other, the periphery of the convexity directly abuts against the edge of the recess.

The limiting plate 116 has a thickness of 0.2 mm to 0.8 mm, preferably 0.3 mm to 0.5 mm, and is preferably produced from spring steel (St. 60). In the embodiment shown in FIG. 22, the limiting plate 116 is immovably fastened in the first end portion 100 to the pin 58, while, in the region of the second end portion 102, the pin 58 is fitted movably in a through-hole 76 configured as a slot.

Figure 34:
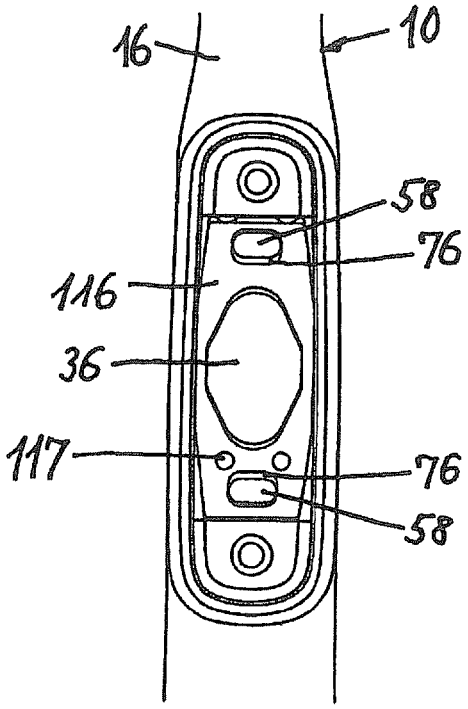
FIG. 34 shows in a view from below the portion of the neck part with a limiting plate placed over the snap dome to prevent overstressing of the snap dome in a further variant.

FIG. 34 shows a configurational variant analogous to that in FIG. 22. The differences are evident on the one hand in the region of the through-holes 76 and the associated pins 58, which are configured as a rectangle with rounded corners, and on the other hand in the connection/fastening between the limiting plate 116 and the snap dome 36, which are represented as circles 117. It can also be seen that the limiting plate 116 is not, as described, of the same length as the snap dome 36, but is made slightly shorter. The limiting plate 116 and the snap dome 36 also have through-holes 76, which are larger than the associated pins 58, so that the movements for triggering the clicking noises are possible.

In FIG. 22, the unloaded state is shown. In this case, the pin 58 abuts against the extreme end of the slot or through-hole 76. With this arrangement, tensile loading of the snap dome is prevented, since the pin 58 cannot move in the slot under tension. Compressive loading is possible, until the pin 58 comes to a stop against the opposite end of the slot or until the limiting plate abuts against the supporting surface 60. Depending on the configuration of the through-holes 76, limitation of the tensile and/or compressive loading is possible. The variant shown allows the various interfacial possibilities between the pin 58 and the through-hole 76 to be seen. The possibilities concerned can be used in any combinations. The pin 58 may abut against the other end (as shown in FIG. 22) of the slot or the through-hole 76; this would be accompanied by the effect that tensile loading is possible, but compressive loading is prevented. The length of the limiting plate 116 is preferably made such that a distance of 0.1 mm to 0.25 mm is present respectively at the end faces of the snap dome 36, between the end faces of the limiting plate 116 and the supporting surface 60. A further possibility for preventing overloading is to introduce supporting means into the clearance 28. For this purpose, for example, a body of hard material may be introduced, formed on which is a notch which in turn permits bending only within a certain range. The depth of the notch is irrelevant, since what is important are the angles; a deep notch has the advantage that the stop effect under bending is greater, so the limitation is stronger. A total angle of about 13° in this case produces a limitation of the movement to 0.5 mm to 0.6 mm in the region of the snap dome from the position of rest into the position under maximum loading.

Furthermore, the device body 10 itself may of course also be configured with a closure part 30 of hard material. The resultant stiffening of the device body 10 may provide support for the snap dome 36.

Figure 23:
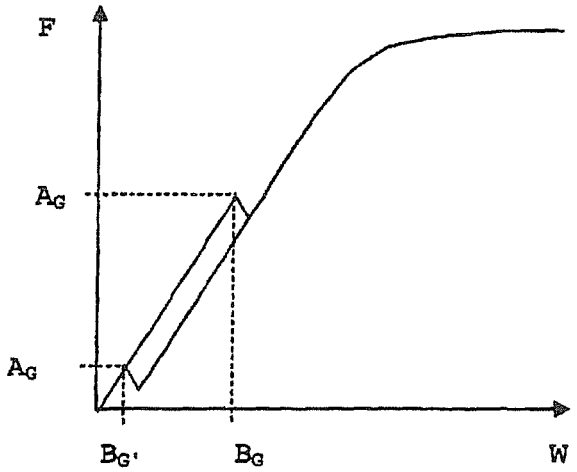
FIG. 23 shows a force-displacement diagram of a corresponding snap dome.

The way in which the toothbrush 12 or an oral hygiene device according to the invention functions can be explained with the aid of the diagram shown in FIG. 23. It shows the force F generated as a function of the deflection W of the head part 14 of the toothbrush 12; also see in this respect the arrows W and F in FIG. 19, respectively for the deflection and the force.

If, with the grip part 18 firmly held, the head part 14 is deflected by means of a striker—for example in the middle of the head part 14 and in a direction at right angles to the longitudinal direction of the device body 10 acting from the user side—, the neck part 16 bends as a result of the elastic properties of the device body 10 or of the carrying part 26. The relationship between the displacement W caused by the bending back and the force (of reaction) F generated by the device body 10 is preferably at least approximately linear. This is dependent in principle on the geometry. On account of the holding geometry 34, both a torque and a compressive force are transferred to the snap dome 36. If, under a limiting bending BG, a limiting pressing force AG is reached, the snap dome 36 springs over into its opposite position in a known way, while producing an acoustic warning signal. This is indicated in the diagram of FIG. 23 by an abrupt reduction in the force F. With a further increase in the bending or the displacement W, the pressing force then continues to increase, until it asymptotically approaches the limiting force. If, however, the bending, and consequently the pressing force, is reduced, the snap dome 36 springs back again into its original position when the further limiting pressing force AG' or the further limiting bending BG' is reached, and thereby in turn emits an acoustic warning signal. The characteristic curve shows a hysteresis.

The snap dome is designed in such a way that the reaching of the limiting pressing force AG and the triggering of the snap dome only cause an insignificant change in the elasticity of the toothbrush. As a result, when the limiting pressing force AG is reached, the head part 14 does not tip away. The user can still use his toothbrush 12 even if he is exerting too much force. The aim is only to warn the user acoustically, without decisively changing the elastic properties.

The snap dome may be designed such that the warning signal when it returns is sounded essentially in response to the same limiting pressing force AG' as when it is triggered (limiting pressing force AG=further limiting pressing force AG'). In an alternative configurational variant, the further limiting pressing force AG' for the warning signal is set lower for when it returns than for when it is triggered (see FIG. 23), in order that the user must relieve the pressure on the toothbrush 12 in practice, and consequently consciously establishes that he has used too much pressure. This leads to a learning effect for the user.

The different limiting pressing forces and limiting bendings are represented in FIG. 23. A typical progression in the application in the finished product is such that, when force/pressure is exerted, the curve is followed from the zero point, passes AG/BG and moves along the curve with increasing W. When the loading is subsequently relieved, the movement is along the same curve until in the vicinity of AG/BG; from this point, the relationship moves on the lower part of the curve up to the point AG'/BG' and, from there, the line for relieving the load is again the same as for applying the load. As mentioned, the points AG/BG and AG'/BG' may also be the same.

In a preferred way, the limiting pressing force AG is chosen between 150 g and 500 g, preferably between 250 g and 450 g, particularly preferably approximately 350 g. The corresponding limiting bending BG with which the head part 14 gives way as a result of the bending of the neck part 16 is, for example, between 5 mm and 15 mm. The further limiting pressing force AG' preferably lies between 50 g and 500 g, particularly preferably between 50 g and 250 g or at 350 g; the associated further limiting bending BG' lies between 1 mm and 15 mm. If AG is not equal to AG', BG' lies between 2 mm and 6 mm, preferably between 2 mm and 4 mm. It should be said in this respect that the values for BG, BG', AG' and also for AG are dependent on many factors that can be set. These include the geometry, the material and the production process, to be precise of the snap dome 36, the device body 10, the cover part 80 and the associated fitting.

If the cover part 80 is formed as shown in FIG. 21, the tongue 96 and the stop tongue 106 move toward each other during the bending of the neck part 16. As soon as they abut against each other, the snap dome 36 is secured against any further increase in stress, although the neck part 16 can be deflected further. The gap 110 is chosen in such a way that the tongue 96 and the stop tongue 106 only contact each other once the snap dome 36 has in each case sprung into the opposite position. The width of the gap 110 is, for example, 0.5 to 2 mm, preferably 0.8 to 1.5 mm. Furthermore, the configuration of the tongue 96 and the stop tongue 106 achieves the effect that, when there is overbending of the snap dome 36 counter to the direction of use, even when the pins 58 are cut off by means of the snap dome (due to the overloading), they cannot escape from the cavity 82. In this way, a further safety function for the user is integrated.

In the case of the embodiment shown in FIG. 22, the snap dome 36 is protected from overloading by a limiting plate 116. It is also possible in the case of this embodiment to use a cover part 80 according to FIG. 21.

Furthermore, it is possible to provide the stop means 112 on the carrying part 26 itself. In this case, the cover part 80 preferably has no stop tongue 106. The stop means of this kind could, for example, be arranged in the recess 46 or in the clearance 28.

During the bending of the neck part 16, the actuating lug 98 of the tongue 96 in each case comes into abutment with the convexity 72 of the snap dome 36 and acts on it during the further bending of the neck part 16. This allows the limiting pressing force AG or limiting bending BG to be set very exactly, or the triggering of the snap dome becomes more exact. Possibly, the tongue 96 together with its actuating lug 98 may be omitted, since they are designed as a setting element for the precise triggering of the mechanism.

Furthermore, it is possible to form the holding geometry 34 correspondingly on the cover part 80, in particular on the frame 84 thereof. In this case, the resting surface 56 and also the pins 58 are formed on the frame 84. In this case, the corresponding counterparts, i.e. the abutting surfaces 92 and also the receiving blind hole 94, are formed on the carrying part 26.

This would mean that, for fitting, the snap dome 36 is placed in the cover part 80 and this subassembly is subsequently fitted on the device body 10 and welded.

There are various possibilities for producing a toothbrush 12 according to the invention, and correspondingly an oral hygiene device according to the invention. Some of these are schematically represented in FIGS. 24 to 33.

Figure 24:
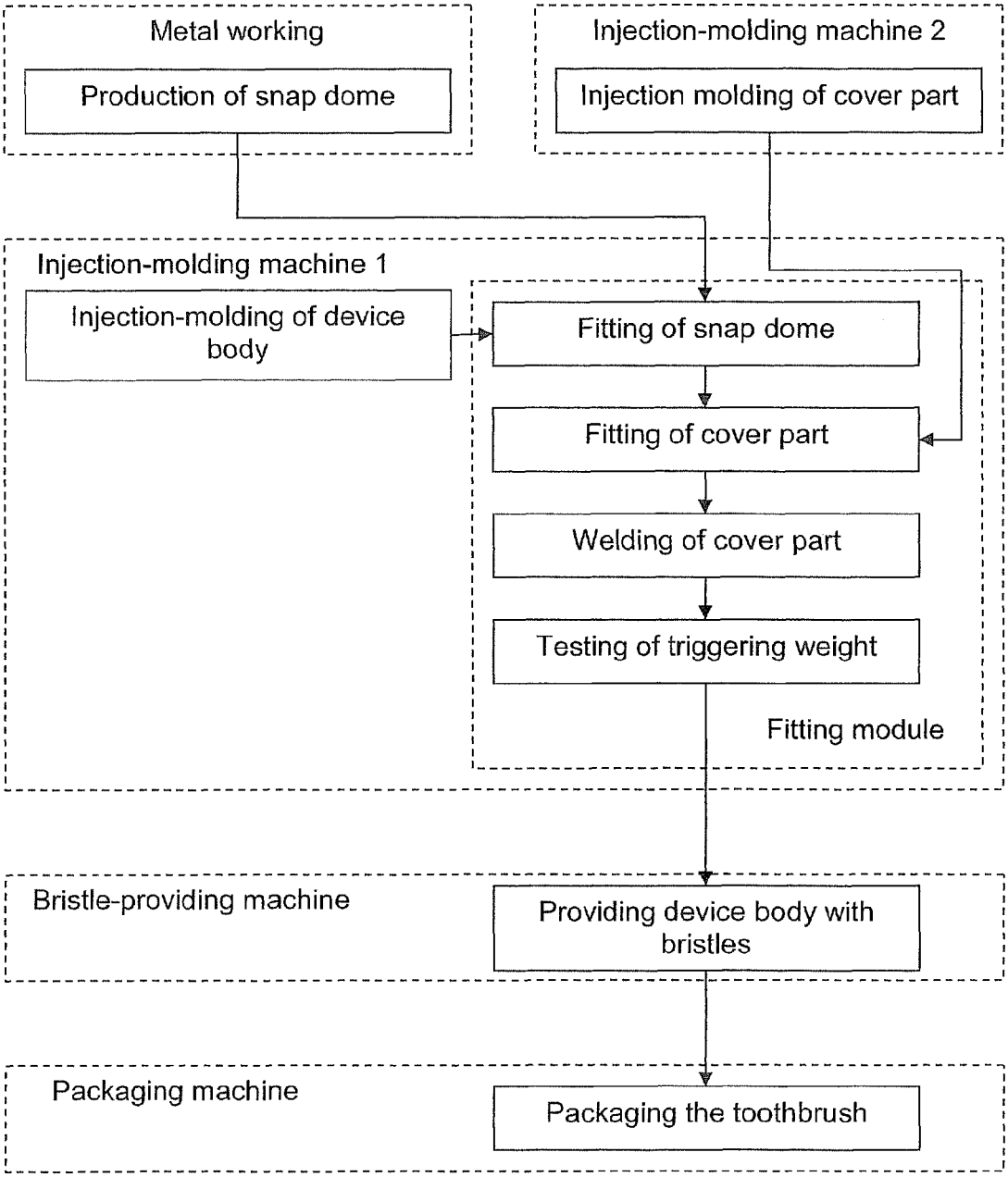
FIG. 24 shows a flow diagram of a first embodiment of a method for producing toothbrushes according to the invention.

In the case of a first possible method, as schematically represented in FIG. 24, in a first step the device body 10 is produced on an injection-molding machine 1, optionally by the two- or multi-component injection-molding process, and the cover part 80 is produced on an injection-molding machine 2, optionally likewise by the two- or multi-component injection-molding process. In advance of or in parallel with this first step, the snap dome 36 is produced in a metal-working station, for example in a punching and stamping process. This step may also be performed elsewhere, i.e. it does not have to take place in the direct vicinity of the injection-molding process.

In a second step, the snap dome 36 is placed in the holding geometry 34 of the transferred device body 10 in a fitting module; also see FIG. 16. The fitting module is integrated directly in the production of the injection-molding machine 1, that is to say is interlinked with it. During the fitting, the pins 58 are inserted in a preferred way into the through-holes 76 of the snap dome 36. The latter then abuts with its end portions 100, 102 on the resting surfaces 56 and against the supporting surfaces 60.

After that, a cover part 80, likewise fed to the fitting module, is fitted on the device body 10 provided with the snap dome 36. In the exemplary embodiment shown further above, the fastening pins 90 thereby come into engagement with the corresponding blind holes 62, the bead 88 comes into engagement with the receiving groove 48 and the pins 58 come into engagement with the assigned receiving blind holes 94. Furthermore, during the fitting of the cover part 80, the clamping connection described further above is established in a preferred way between said cover part and the device body 10. During the fitting of the cover part 80, attention should possibly be paid to the orientation of the cover part 80 or the tongue 96 in the cover part 80. In the end product, this tongue is preferably formed from the head part 14. In this case, the fastening pins 90 are preferably formed in different lengths on the head part side and the grip part side, although the same lengths are also possible.

In a fourth step, the cover part 80 is undetachably connected to the device body 10, likewise in the fitting module. This takes place in a preferred way by a welding method, preferably ultrasonic welding.

In the case of the embodiment shown further above with fastening pins 90 and corresponding blind holes 62, spot weldings are preferred, weldings in which the sonotrode is placed on the cover part 80 or the frame 84 at the fastening pins 90 and the cover part 80 is only contacted at these points. In the remaining regions of the surface, an exposed situation is created. However, 3D welding, in particular 3D ultrasonic welding, is also possible. In this case, the sonotrode is placed on the cover with the bead 88 on the frame 84, whereby the bead 88 is welded to the device body 10 in the region of the receiving groove 48. Preferably, spot weldings are carried out, since they are less laborious, less complicated and, moreover, also not as critical in comparison with 3D welding in terms of the method involved. Other connecting methods are also possible.

In a fifth step, functional testing of the snap dome 36 or of the fitted and welded system as a whole is performed, likewise in the fitting module, by means of a functional check referred to in the diagram as "testing of triggering weight". This test is necessary, since the function depends on many different parameters, for example also the material properties of the device body 10 and the snap dome 36. In the test, for example, the head part 14 is subjected to a test force greater than the limiting pressing force AG by means of a striker. At the same time, the displacement W that the head part 14 undergoes under the loading as a result of the bending of the neck part 16 may be detected. Furthermore, the acoustic warning signal which the snap dome 36 produces when it springs into place may be simultaneously determined by means of a microphone. Correspondingly, the return of the snap dome 36 into its starting position when the striker moves back may be tested. If the values measured lie within predetermined limit values, the functioning is in order. In a preferred way, the head part 14 is subjected to the force described above at least twice, only the second application of force being evaluated for the functional check.

The first application of force is an activation of the mechanism, the triggering values of which may deviate from the values of the further triggerings. This testing of the triggering weight preferably takes place in a step directly after the welding. In principle, however, the test sequence may be completed at various points in the process sequence; it may even not take place until directly before or after the toothbrush is provided with bristles or directly before the toothbrush is packaged. The test is therefore not strictly tied to the fitting module. However, for economic reasons, the testing of the triggering weight takes place as early as possible in the process, in order that, in the case of a defective function, no further value is added to the defective product. When incorporating the testing of the triggering weight in the process, the extent to which the process steps following the test have an effect on the product, or specifically on the function, must of course also be taken into account. Strong vibrations or other loads on the device body 10 may impair the function, for example if the clamping or holding geometry 34 is damaged as a result, or if the snap dome 36 as such is overloaded. Furthermore, it must be taken into account what happens to the device body 10 before it reaches the user. For example, if the device body 10 is still warm after the injection molding, it will therefore have different measured values during direct fitting thereafter and the corresponding subsequent test than if it has cooled down and finished shrinking. Furthermore, a certain aging of the plastic takes place (also after cooling down), which in turn is accompanied by a certain change in the measured values. These explanations show that, depending on where the test is arranged in the process, it may happen that the test values in the test are different from the values intended for the user. The test values must therefore be established according to where it is arranged in the process, if need be also by conducting trials.

The fitting module may, for example, have in a known way a turntable with holding elements for the device body 10 distributed in the circumferential direction. In a preferred way, said device body is in this case firmly held in the region of the grip part 18. By indexed turning of the turntable from one working station to the next, the aforementioned method steps two to five are performed one after the other.

Furthermore, the fitting module may also be set up on a chain conveyor or some other transporting system. It goes without saying that, in general, the fitting module may also be understood as meaning a number of stations with manual workplaces and corresponding auxiliary devices. Depending on the production site, this may be more cost-effective than a sophisticated, automated fitting installation. This applies to all the fitting tasks mentioned in this document.

As indicated by the rectangle depicted by dashed lines that surrounds the injection-molding machine 1 and the fitting module, the injection-molding machine 1 and the fitting module are connected in-line, or the fitting module is integrated in the process sequence and in the injection-molding machine 1, while the metal working and the injection-molding machine 2 produce offline and the snap domes 36 and the cover parts 80 are fed to the fitting module from an intermediate store.

In a way corresponding to the method as shown in FIG. 24, the finished tested device body 10 is fed to a bristle-providing machine, in which the bristles forming tufts of bristles 104 are inserted into the bristle receiving holes 24 of the head part 14 in a known way, for example by means of pieces of anchor wire. Other bristle-providing methods, such as IMT, IAP or AFT, are likewise possible by analogy. Further processing operations are preferably performed in a known way in the bristle-providing machine, for example the free ends of the bristles are profiled and rounded. Subsequently, the finished toothbrushes 12 are fed to a packaging machine, in which they are, for example, packaged in blister packs. Here it is possible to provide a consumer package in which the neck part 16 can deflect elastically. Consequently, the user can try out the snap mechanism at the point of sale. This can be achieved, for example, by openings in the package or by a movable element of the package.

Figure 25:
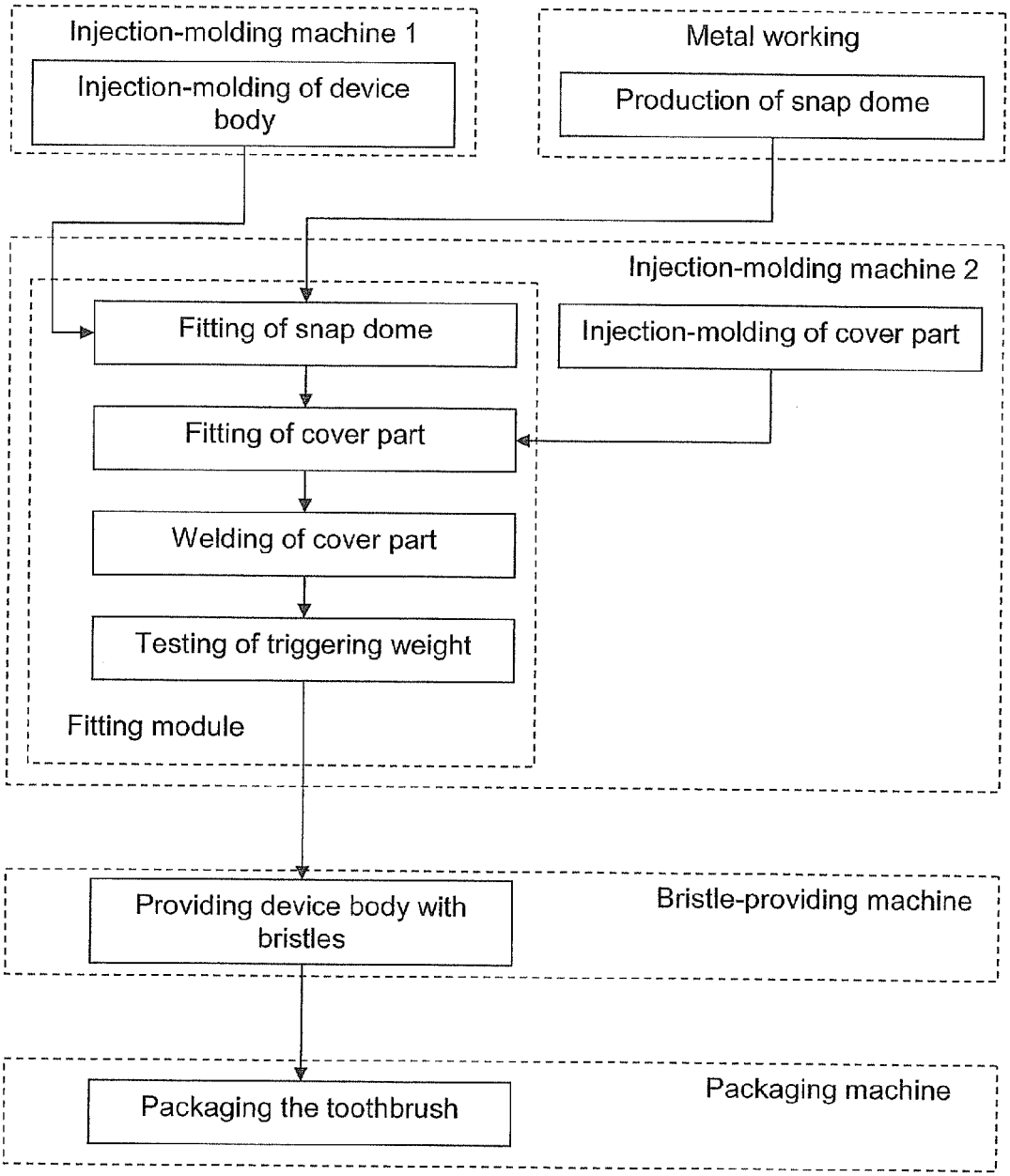
FIG. 25 shows a flow diagram of a second embodiment of a method for producing toothbrushes according to the invention.

While in the case of the method sequence shown in FIG. 24 the injection-molding machine 1 operates in line with the fitting module, in the case of the method sequence as shown in FIG. 25 the fitting module is connected in line with the injection-molding machine 2, the production of the cover part 80. Whereas the metal working and the injection-molding machine 1 produce offline. Otherwise, the method proceeds in the same way as described in connection with FIG. 24.

Figure 26:
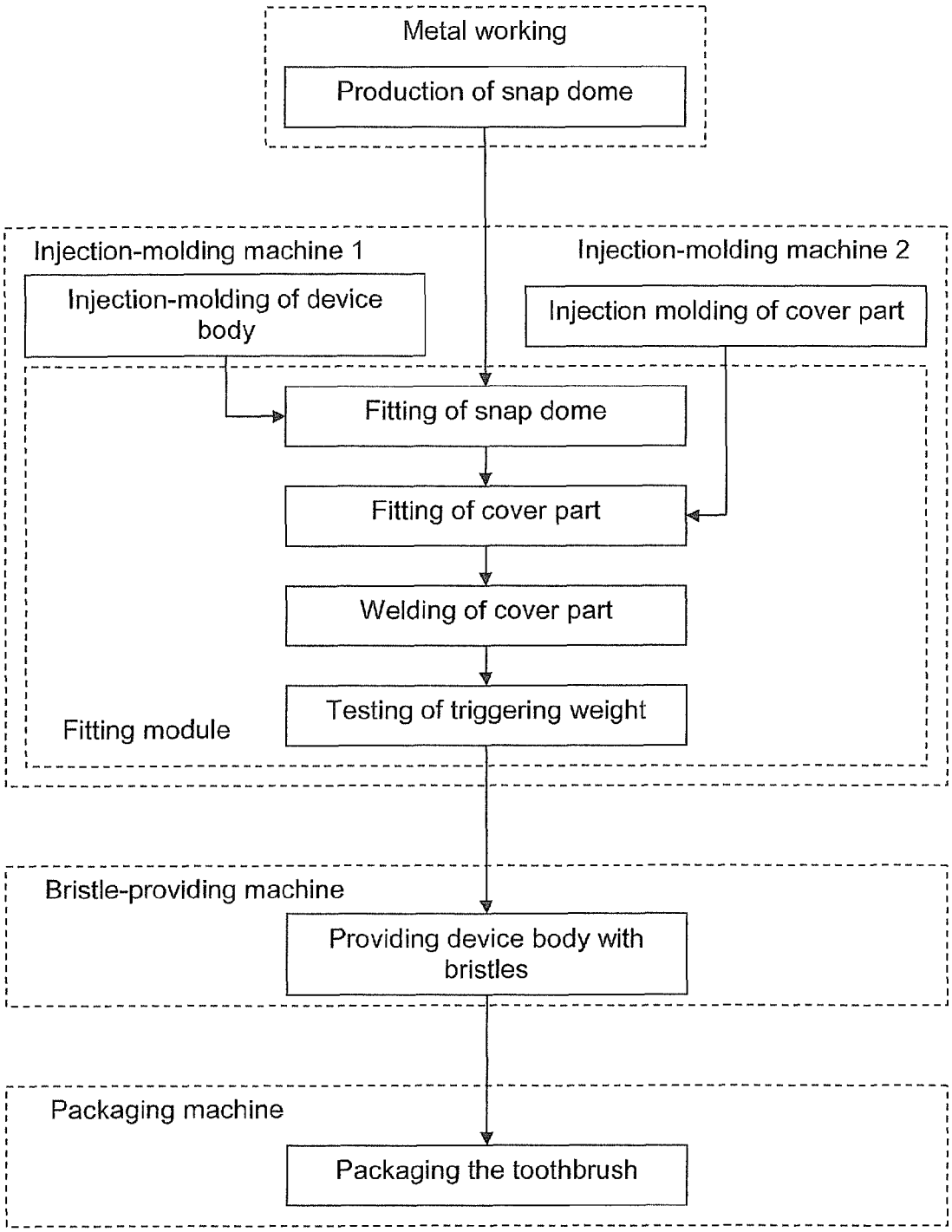
FIG. 26 shows a flow diagram of a third embodiment of a method for producing toothbrushes according to the invention.

In the case of the method sequence shown in FIG. 26, the injection-molding machine 1 and the injection-molding machine 2 are connected in-line, that is to say interlinked with the fitting module. This means that the device bodies 10 produced in the injection-molding machine 1 and the cover parts 80 produced in the injection-molding machine 2 are fed to the fitting module in-line, i.e. directly interlinked. In this case, a buffer may also be provided between the various process steps. Whereas the snap domes 36 were produced off-line and fed to the fitting module. Otherwise, the method steps proceed in precisely the same way as described in connection with FIG. 24.

Figure 27:
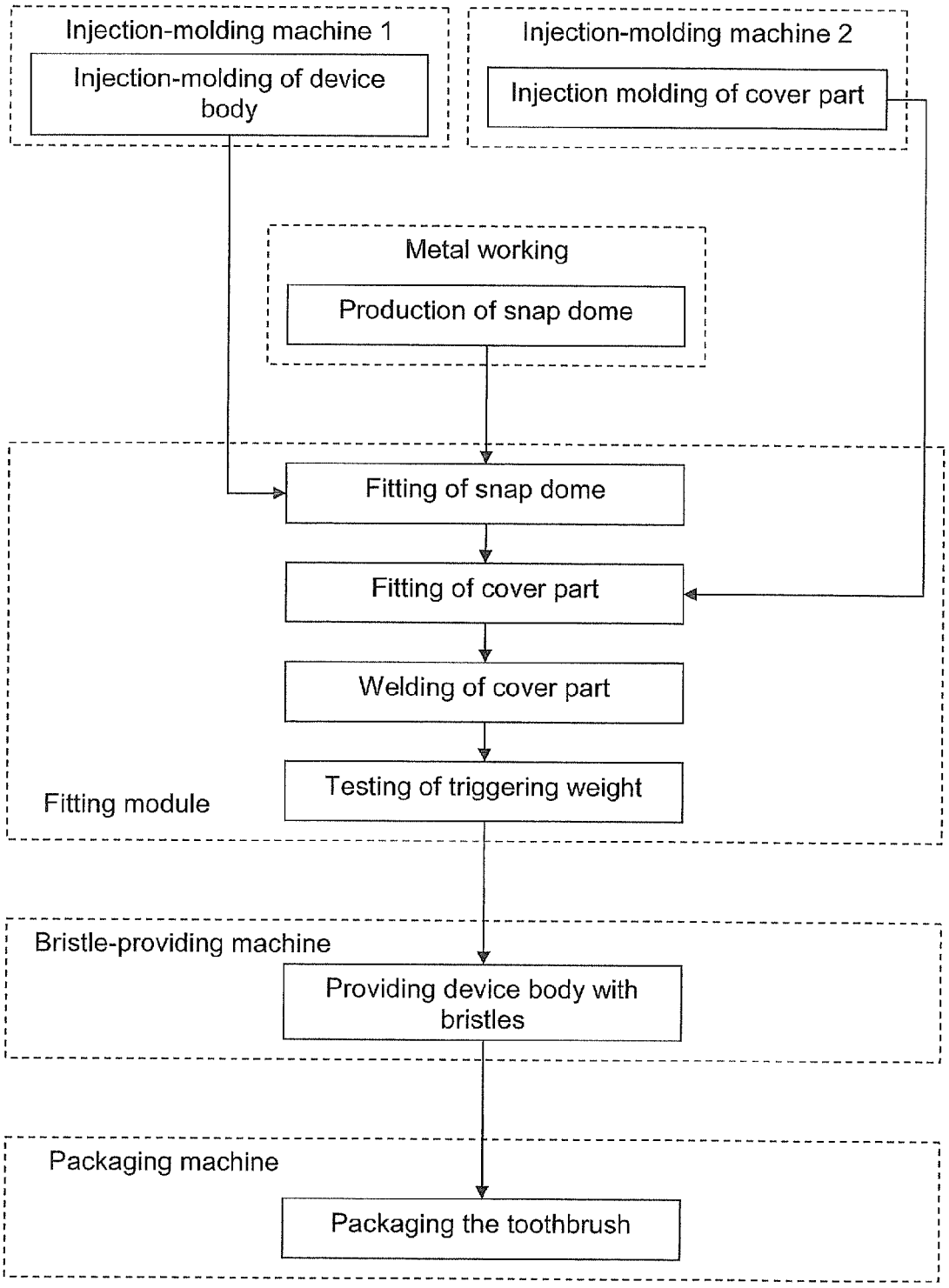
FIG. 27 shows a flow diagram of a fourth embodiment of a method for producing toothbrushes according to the invention.

In the case of a further possible method, as indicated in FIG. 27, not only the device bodies 10 made by means of the injection-molding machine 1 and the cover parts 80 made by means of the injection-molding machine 2 but also the snap domes 36 made by means of the metal-working station are produced off-line, that is to say they are produced independently of one another. The corresponding parts are then fed to the separately formed fitting module, which is not interlinked with the process. There, the fitting of the snap dome 36 and the cover part 80 as well as the welding and functional check are performed in precisely the same way as described in connection with FIG. 24.

Figure 28:
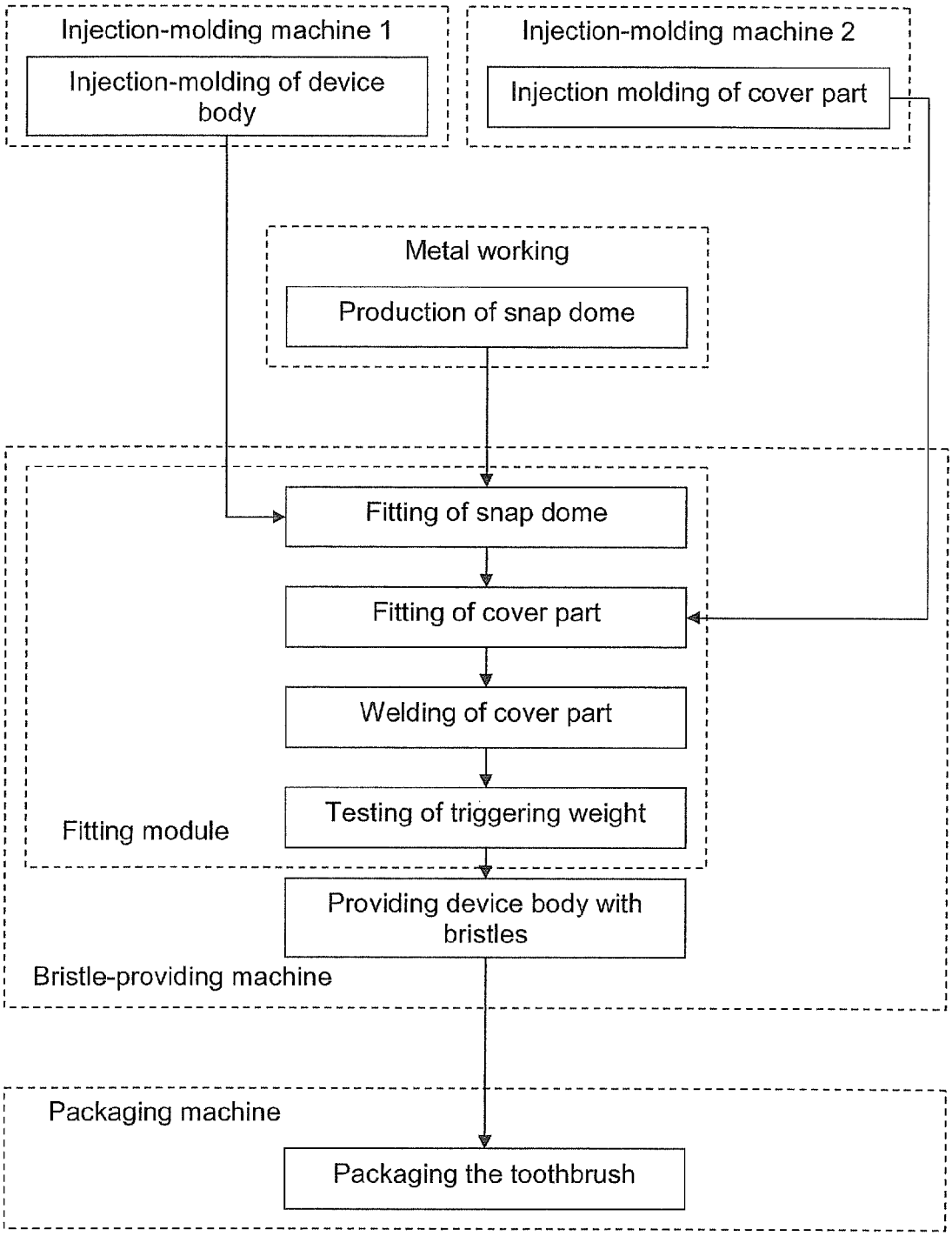
FIG. 28 shows a flow diagram of a fifth embodiment of a method for producing toothbrushes according to the invention.

Furthermore, it is also possible to assign the fitting module to the bristle-providing machine in-line. In this case, as shown in FIG. 28, the injection-molding machine 1, the injection-molding machine 2 and the metal-working station may produce the device bodies 10, the cover parts 80 and the snap domes 36 off-line. These parts are then fed to the fitting module at the bristle-providing machine for fitting, welding and testing. Although the process of providing the toothbrush 12 with bristles also takes place in the bristle-providing machine, it is arranged after the fitting process. Otherwise, the individual method steps proceed in the same way as explained in connection with FIG. 24.

Figure 29:
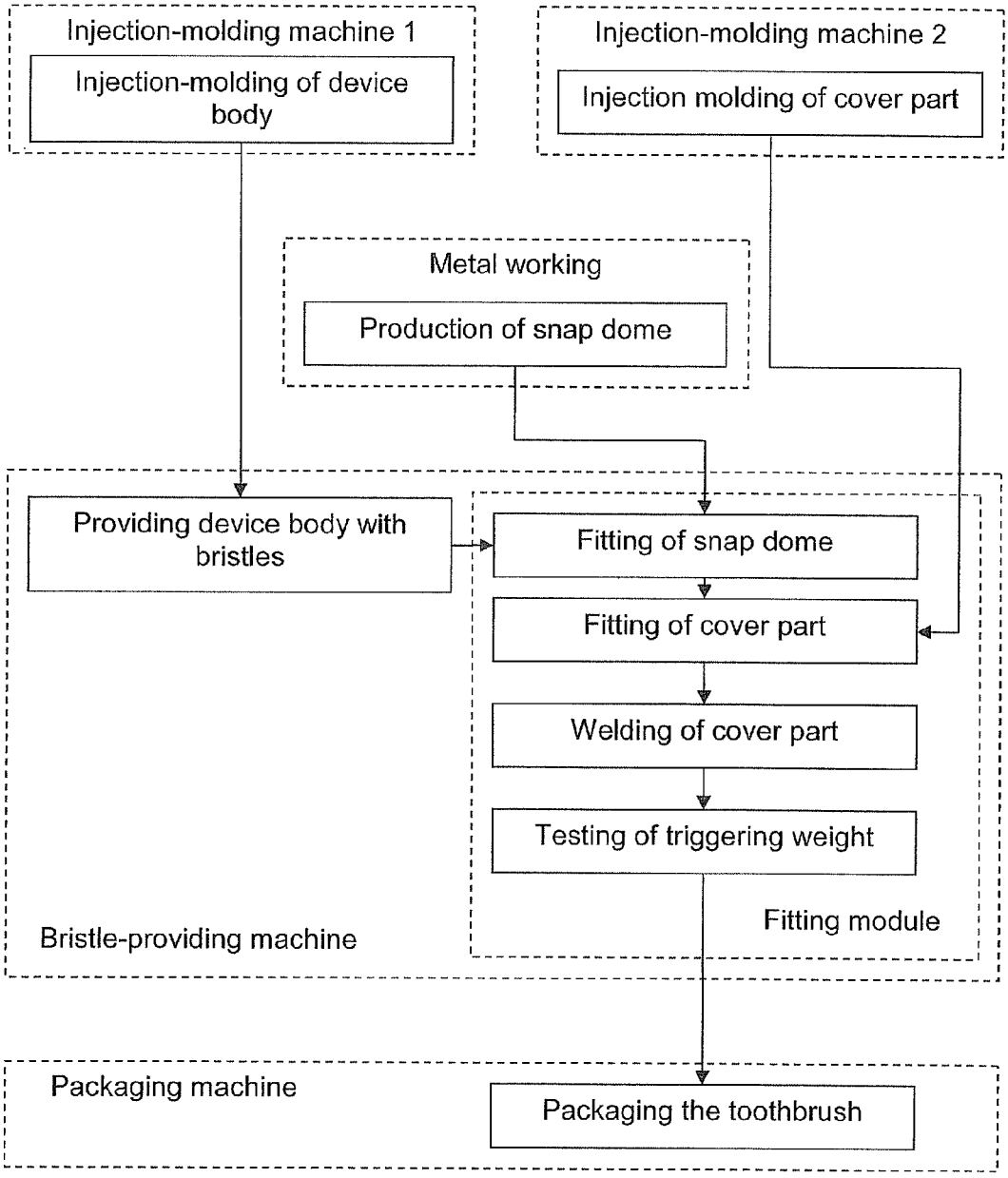
FIG. 29 shows a flow diagram of a sixth embodiment of the method for producing toothbrushes according to the invention.

In the case of the method sequence indicated in FIG. 29, the fitting module is likewise assigned to the bristle-providing machine in-line, but first the bristles are provided and then the fitting is carried out. In this case, the device bodies 10 that are produced off-line by means of the injection-molding machine 1 and fed to the bristle-providing machine are first provided with bristles in the known way. Subsequently, the device bodies 10 provided with bristles are fed to the fitting module, where, in the same manner as described in connection with FIG. 24, the snap dome 36 and the cover part 80 are fitted, the welding of the cover part 80 to the device body and then the functional check are performed. The packaging of the finished toothbrushes then takes place in a packaging machine.

The integration of the fitting process in the bristle-providing machine before the bristles are provided (see FIG. 28) brings the advantage over the variant of fitting after the bristles are provided (see FIG. 29) that a possible source of errors can be eliminated. The bristle-providing process is, in principle, accompanied by many vibrations, to which the device body 10 is exposed. The body is weakened at this point by the recess 46 in the neck region. If it is exposed to the vibrations in this state, this can have an influence on the properties of the device body 10 in the region of the neck part 16. If the cover part 80 has been fitted when the device body 10 is exposed to the vibrations, the neck part 16 is more stable and the change in properties referred to can be avoided. This of course also applies to the processes represented in FIGS. 24 to 27; the fitting has in each case taken place before the provision of bristles is carried out.

Figure 30:
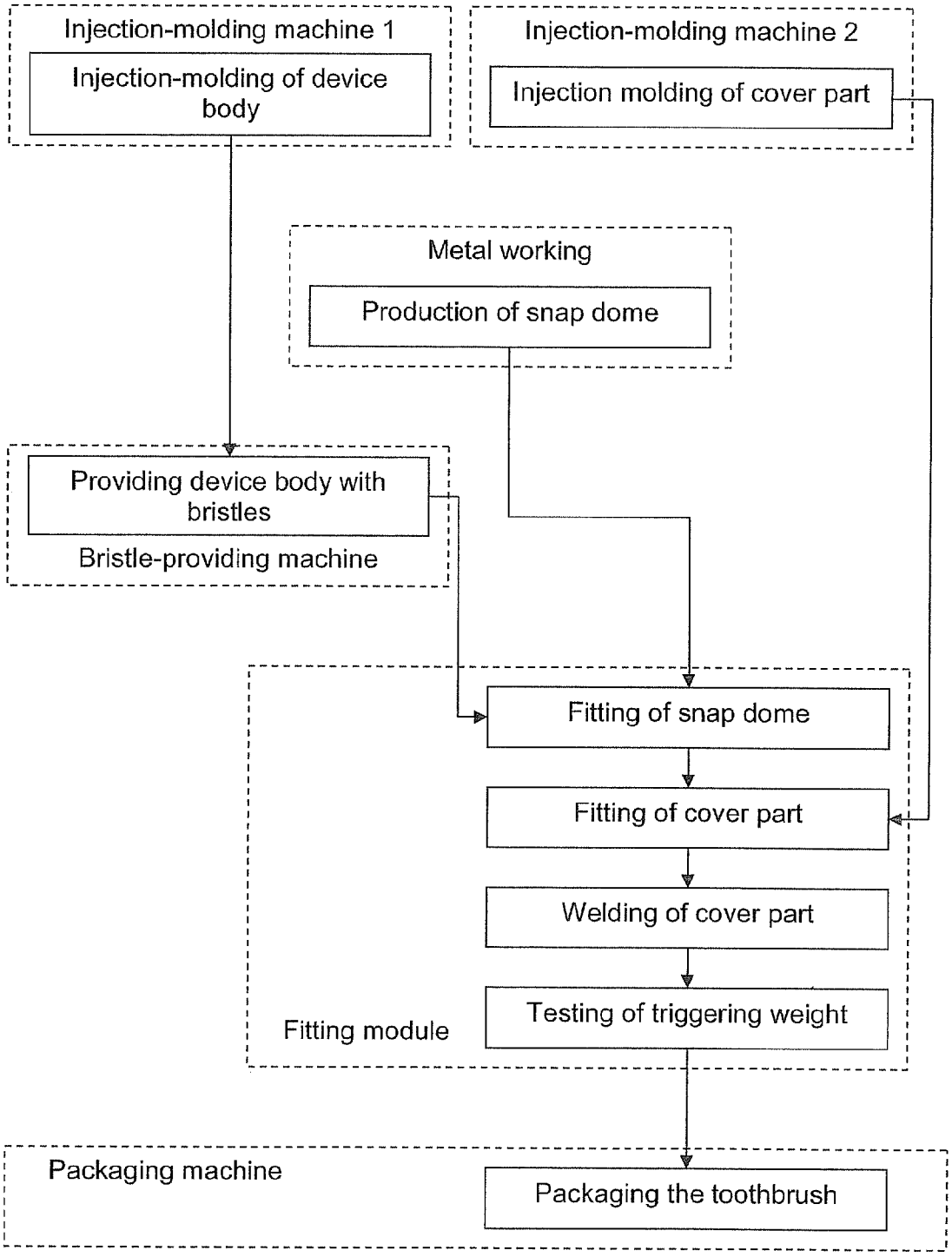
FIG. 30 shows a flow diagram of a seventh embodiment of the method for producing toothbrushes according to the invention.

Also in the case of the method sequence indicated in FIG. 30, the device bodies 10 that are produced off-line by means of the injection-molding machine 1 are fed to the bristle-providing machine, where the head parts 14 are provided with the tufts of bristles 104. The device bodies 10 provided with bristles off-line are then fed to the fitting module, in the same way as the snap domes 36 and cover parts 80 produced off-line. As in the process in FIG. 27, the fitting module itself constitutes an independent process, which is not directly interlinked. As described further above, the fitting of the snap dome 36 and the cover part 80, the welding of the cover part to the device body 10 and the functional check are performed in the fitting module. From the fitting module, the finished toothbrushes 12 are fed to the packaging machine for packaging. The steps are in turn configured in a way analogous to the steps described in connection with FIG. 24.

Figure 31:
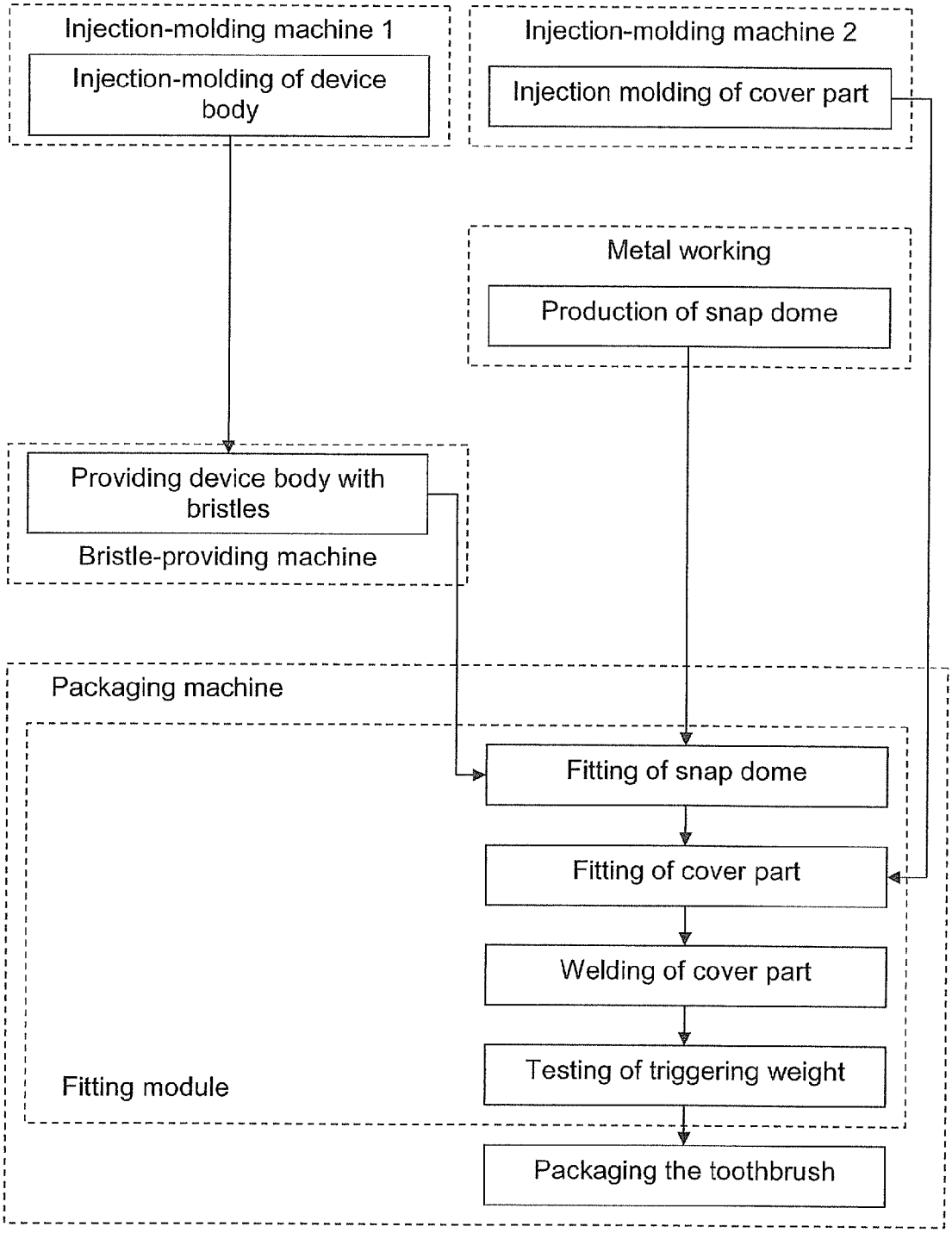
FIG. 31 shows a flow diagram of an eighth embodiment of the method for producing toothbrushes according to the invention.

It is also possible to connect the fitting module in line with the packaging machine, as FIG. 31 shows. The device bodies 10 produced off-line by means of the injection-molding machine 1 are fed to the bristle-providing machine, provided with bristles and stored again. In the next step, the device bodies 10 provided with bristles are passed on to the fitting module. The snap domes 36 and the cover parts 80, produced by means of the injection-molding machine 2, are likewise fed to the fitting module, where the fitting, welding and functional check are performed in the same way as described above. From the fitting module, the finished, checked toothbrushes 12 then pass in-line, i.e. directly interlinked, to the packaging machine. The steps are in turn configured in a way analogous to the steps described in connection with FIG. 24.

The integration of the fitting module in the process can bring significant advantages. For instance, the parts, or at least some of the parts, to be processed are already aligned, i.e. held in a defined manner, if the fitting module is integrated directly in line with an installation. This means that at least an aligning process is no longer needed. One disadvantage may possibly be the efficiency of the process. The interlinkage of more process steps is also accompanied in each case by a drop in efficiency. However, it is also the case, for example, that reliable processes or processes that require certain constant running in order for them to function optimally suddenly no longer produce the same product quality as a result of fitting being integrated.

Figure 32:
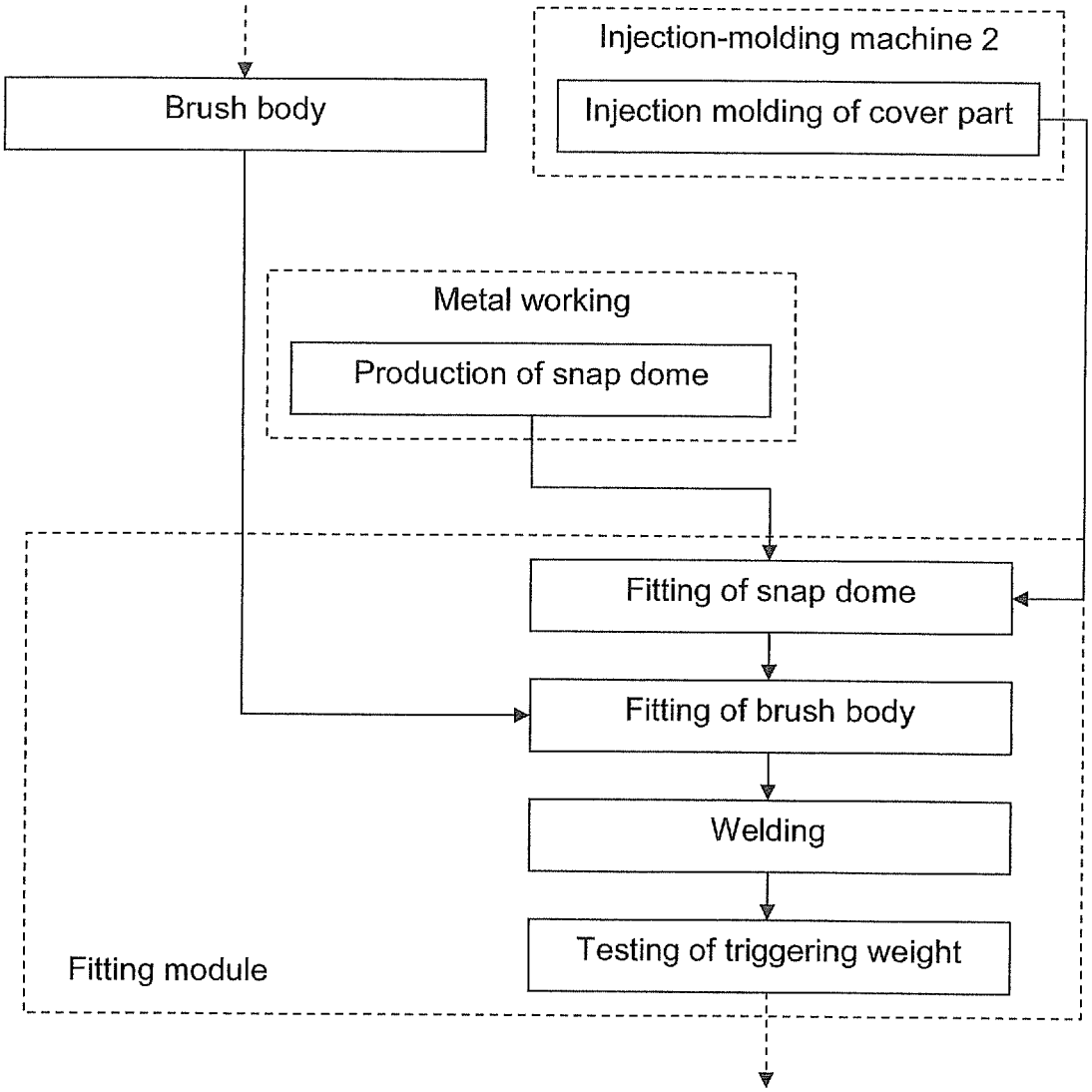
FIG. 32 shows a flow diagram of a ninth embodiment of the method for producing toothbrushes according to the invention.

The opposite approach is to treat the fitting process as an independent step, as shown in FIG. 27. This arrangement has the effect of delinkage, that is to say less dependence on the other process steps. Conversely, the handling is more laborious with respect to logistics and the feeding/aligning of the parts. Furthermore, such an arrangement can, for example, serve a number of injection-molding, bristle-providing or packaging processes. In the method sequence shown in FIG. 32, it is shown how the process changes if the snap dome 36 is placed in the cover part 80 instead of in the device body 10 and is only subsequently attached to the device body 10. In the case of the method sequence as shown in FIG. 32, cover parts 80 on which the holding geometry 34 for the snap domes 36 is formed are produced by means of the injection-molding machine 2. These cover parts 80 are fed to the fitting module, where they are received by corresponding holding elements. In the fitting module, the fitting of the snap dome 36 produced off-line into the holding geometry 34 of the cover part 80 concerned is then performed; this takes place in the same way as when the holding geometry 34 is formed on the device body 10. Subsequently, a device body 10 produced off-line by means of the injection-molding machine 1 is respectively fed to the fitting module and fitted there onto the cover part 80 provided with the snap dome 36. In this case, a clamping connection is established in a preferred way, likewise in the first step. In a subsequent step, the welding of the cover part 80 and the device body 10 is performed as described further above, in turn in the fitting module. After the functional test, the finished toothbrushes 12 are taken away from the fitting module and fed to the corresponding machines for providing bristles and packaging, or to the corresponding intermediate stores.

In the case of this embodiment, it goes without saying that it is also conceivable to feed to the fitting module device bodies 12 that have already been provided with bristles or to configure the method in terms of the basic sequence and the interlinkage in the way shown in FIGS. 24 to 31, i.e. fitting in the reverse sequence is independent of the production sequence. The configuration in which the snap dome 36 is placed in the cover part 80 and subsequently fitted onto the device body 10 is accompanied by the effect that the fitting takes place from the underside of the toothbrush 12. This means that the cover part 80 with the placed-in snap dome 36 is fitted onto the device body 10 from below. Depending on the integration of the fitting module in the production process, this kind of fitting may be of advantage, possibly on a bristle-providing machine, if the device body 10 is held in the head part 14 and then the fitting is intended to take place in a directly integrated manner.

In principle, the production sequence may also be interlinked, for example in that the injection-molding process is linked with the bristle-providing process and the packaging process completely or parts thereof.

If a limiting plate 116 is used in the mechanism, as shown in FIG. 22, this is fitted together with the snap dome 36. Various possibilities exist here for the configuration.

On the one hand, it is possible to connect the limiting plate 116 to the snap dome 36 already before the fitting in the device body 10. In this case, the two parts may be connected to each other by spot welding, soldering or brazing, adhesive bonding, riveting or other methods. As a result, it is possible to allow the process to proceed in the way shown in FIGS. 24 to 33. The process does not require any fundamental adaptation, since the connected part (consisting of the snap dome 36 and the limiting plate 116) can be handled as a unit just like a single snap dome 36. It is important when connecting the two elements that a relative movement is still at least partially possible between the snap dome 36 and the limiting plate 116.

This means that the connection is preferably established only on one side of the unit, preferably in the region of the end faces 74.

When the limiting plate 116 is connected, it may be necessary to provide additional through-holes on the snap dome 36. This may be necessary, for example, if the two parts are riveted.

The fastening of the two parts preferably takes place in the region around the through-holes 76 on the snap dome 36, to be precise only on one side of the snap dome 36.

On the other hand, it is possible to fit the two parts, the snap dome 36 and the limiting plate 116, separately. If the sequences shown in FIGS. 24 to 33 are considered, this means that first the snap dome 36 is inserted into the holding geometry 34 in the "fitting snap dome" step and, directly thereafter, a separately fed limiting plate 116 is inserted into the holding geometry 34. The feeding and fitting of the limiting plate 116 is not explicitly shown in FIGS. 24 to 33.

Figure 33:
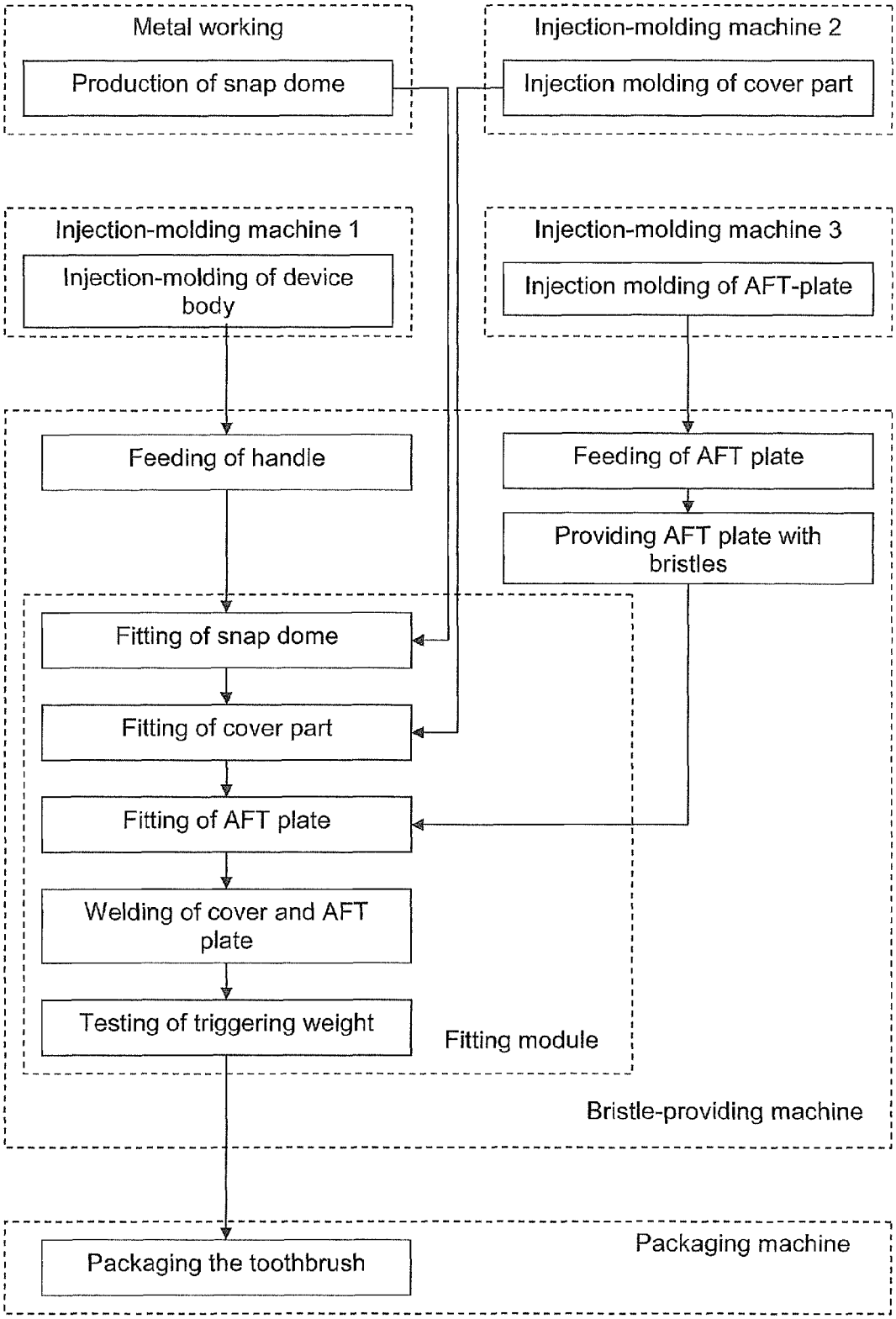
FIG. 33 shows a flow diagram of a tenth embodiment of the method for producing toothbrushes according to the invention.

The production of toothbrushes by the AFT method (Anchor Free Tufting) is generally known. FIG. 33 shows a possible method sequence for producing toothbrushes according to the invention on the basis of the AFT method.

The injection-molding machine 1 is used to produce device bodies 10, which are then fed to the fitting module assigned to the AFT bristle-providing machine. The snap domes 36 produced in the metal-working station are likewise fed to this module, where their fitting into the device body 10 is performed, as described further above. Cover parts 80 produced by means of the injection-molding machine 2 are likewise fed to the fitting module, where they are fitted—as described further above—onto the device body 10 provided with a snap dome 36. It should be mentioned at this point that the head part 14 of the device body 10 is in this case not provided with bristle receiving holes 24 but with a receiving contour for a carrier plate (AFT plate).

These carrier plates are produced by means of an injection-molding machine 3, in a preferred way from a hard component or by the multi-component injection-molding process from one or more hard components and one or more soft components. The carrier plates are fed to the bristle-providing machine, where they are provided with bristles in the known way. From the bristle-providing machine, the carrier plates provided with bristles pass in-line to the fitting module, where they are inserted into the head part 14. During the subsequent welding, on the one hand the cover part 80 and on the other hand the carrier plate are firmly connected to the device body 10, in a preferred way by means of ultrasonic welding.

The welding may take place in two separate steps or in a single step, depending on the configuration of the toothbrush 12 and the welding device. The welding in only one step may in turn be performed by two separate welding devices (two sonotrodes) or by a shared welding device (a single sonotrode), in which case the cover part 80 and the entire mechanism should be arranged on the upper side 20 of the toothbrush 12.

The cover part 80 and the carrier plate are preferably welded independently of each other, i.e. in two separate steps and by means of sonotrodes that are not connected. In this way, the individual weldings can be optimized.

Thereafter, the functional check is also carried out in the fitting module. The ready-tested toothbrushes 12 then pass into the packaging machine.

It goes without saying that variants in the process sequence are also possible for the production of AFT toothbrushes 10. The various methods for this are based on the sequences shown in FIGS. 24 to 31 and also on the process sequence with the alternative fitting as shown in FIG. 32. In this case, the punching process by means of anchor plates is replaced by the AFT process.

In a preferred way, a spring steel is used for the production of the snap domes 36, in particular a high-grade steel, such as for example X10CrNi, which corresponds to a steel 1.4310. The snap dome is produced in a punching and stamping/bending method (=forming method). In particular if high-grade steel is not used, there is the possibility of subjecting the snap domes 36 to a surface treatment or surface finishing. For example, they may be coated with silver, nickel, gold or tin. This may be desired in particular whenever transparent or translucent plastics are used, so that the snap dome 36 is visible or detectable from the outside.

The snap domes 36 are of a length of between 5 mm and 25 mm, in a preferred way between 13 mm and 17 mm, and their width is 3 mm to 9 mm, preferably 5 mm to 6.6 mm. The thickness of the metal sheet for producing the snap domes 36 is 0.03 mm to to 0.5 mm, preferably 0.05 mm to 0.1 mm. The beveling of the outer sides is between 3° and 12°, preferably between 6° and 9°.

Alternatively, the snap dome 36 may also be produced from plastic, preferably a hard component. Furthermore, it is also alternatively possible for a number of through-holes 76 to be provided on each side, in order to position and hold the snap dome 36 optimally. These should, however, always be made symmetrical to the longitudinal and transverse axes.

For the sake of completeness, it should also be mentioned that toothbrushes 12 according to the invention may be produced by the known IMT method (In Mold Tufting) or the IAP method (Integrated Anchorless Production) and by other brush production methods.

Furthermore, the use of bristles of any form is also possible for carrying out the invention. Conventional cylindrical bristles as well as pointed bristles may be used, including in combination; apart from that, soft-elastic cleaning and massaging elements may also be integrated in the bristle area.

Likewise for the sake of completeness, it should be mentioned that the toothbrushes 12 may be of a length of up to 210 mm. In a preferred way, the length lies between 120 mm and 140 mm or between 190 mm and 200 mm. The head part 14 is between 8 mm and 20 mm, preferably 10 mm and 16 mm, wide. The length of the head part 14 is 10 mm to 35 mm, preferably 15 mm to 24 mm or 26 mm to 30 mm. The neck part 16 is preferably of a width and height of respectively 4 mm to 14 mm, preferably of 6 mm to 10 mm. The thumb rest 38 is preferably at a distance from the free end of the grip part 18 of 70 mm to 130 mm, in particular of 80 mm to 110 mm.

It goes without saying that the configurational variants shown in this document are given by way of example and the individual refinements and elements of these configurational variants may be combined with other configurational variants without departing from the scope of this invention.

It goes without saying that the descriptions given for specific figures can also be applied to other figures that show the same or similar refinements and in which the refinements are not described in the same detail.

It goes without saying that the mechanism described above and shown in the figures can be used not only for an oral hygiene device. It is conceivable to use this mechanism analogously for other applications in which the pressing pressure must be monitored.

This may be the case with other body care products, in particular shaving and cosmetic products, as well as for medical products. In this sense, the embodiments in the description and in the drawing are given for oral hygiene articles by way of example, in particular such articles with an application head configured as a brush. For reasons of readability, we have refrained here from giving a full description of these alternative product categories. It goes without saying that the brush head would in this case be replaced by the application head of this product category. It also makes sense in the case of these alternative products to make the application head exchangeable, in order that the mechanism can have a lifetime lasting for a number of application heads.

The invention claimed is:

1. An oral hygiene device, particularly a toothbrush, with a device body, comprising:

a head part, which defines a use side, a neck part adjoining and carrying said head part, and a snap dome, arranged on the neck part, for producing an acoustic warning signal when a limiting bending of the neck part is exceeded as a result of a limiting pressing force in the direction of the use side of the head part being exceeded, wherein the neck part comprises a cavity bounded by a first side and a second side, and wherein a cover part closes off the first side of the cavity and a closure part closes off the second side of the cavity so as to form a space in the cavity between the first and second sides.

2. The oral hygiene device as claimed in claim 1, characterized in that the snap dome is fastened to the device body exclusively with a first end portion, facing the head part, and with a second end portion, facing away from the head part and at a distance from the first end portion.

3. The oral hygiene device as claimed in claim 1, wherein the device body has a recess, in which the snap dome is arranged, and the recess is closed off from the surroundings by means of the cover part, fitted on the device body, for forming the cavity.

4. The oral hygiene device as claimed in claim 3, wherein the recess is closed by means of the cover part on the underside, opposite from the use side.

5. The oral hygiene device as claimed in claim 3, wherein the device body has a carrying part with the recess and a holding geometry for the snap dome, and the cover part is fitted on the carrying part.

6. The oral hygiene device as claimed in claim 5, wherein the carrying part is produced from a hard component.

7. The oral hygiene device as claimed in claim 5, wherein the cover part has a frame, of a hard component, and a soft component part closing an opening formed by the frame.

8. The oral hygiene device as claimed in claim 5, wherein the cover part or the carrying part has an actuating element, which is intended for acting on the snap dome during the bending of the neck part.

9. The oral hygiene device as claimed in claim 8, wherein the actuating element has a tongue, which is arranged on the cover part or on the carrying part, protrudes into the cavity in the longitudinal direction of the device body and is intended for acting with an actuating lug, on the snap dome during the bending of the neck part.

10. The oral hygiene device as claimed in claim 5, wherein the carrying part has on the side of the recess facing the head part and on the side facing away from the head part a respective resting surface for a first and a second end portion of the snap dome, and the cover part keeps the end portions in abutment with the resting surfaces.

11. The oral hygiene device as claimed in claim 1, wherein a limiting plate, which protects the snap dome from excessive tensile and/or compressive loading, is placed on the snap dome.

12. A method for producing an oral hygiene device, particularly a toothbrush, as claimed in claim 1, wherein in a first step the device body and the cover part, with a holding geometry for the snap dome, are produced by the injection-molding process, in a second step the snap dome is placed in the holding geometry, in a third step the cover part is inserted into the device body, and in a fourth step the cover part is welded to the device body.

13. A method for producing an oral hygiene device, particularly a toothbrush, as claimed in claim 1, wherein in a first step the device body, with a holding geometry for the snap dome, and the cover part are produced by the injection-molding process, in a second step the snap dome is placed in the holding geometry, in a third step the cover part is inserted into the device body, onto the snap dome, and in a fourth step the cover part is welded to the device body.

14. The method as claimed in claim 13, wherein, in the first step, a respective resting surface for a first and a second end portion of the snap dome and a pin, protruding beyond the resting surfaces, are formed as the holding geometry on the side facing the head part and on the side facing away from the head part.

15. The method as claimed in claim 13, wherein, in the third step, a clamping connection is established between the cover part and the device body.

16. The method as claimed in claim 13, wherein, to check the function of the snap dome, in a fifth step a test force exceeding the limiting pressing force is applied to the head part.

17. The method as claimed in claim 13, wherein a toothbrush is produced as the oral hygiene device, and, between the first and second steps or after the fifth step, the head part is provided with bristles by means of conventional punching.

18. The method as claimed in claim 13, wherein a limiting plate is fitted on the snap dome and the fitting of the limiting plate is performed along with or directly after the fitting of the snap dome.

19. An oral hygiene device, particularly a toothbrush, with a device body, comprising:

a head part, which defines a use side, a neck part adjoining and carrying said head part, and a snap dome, arranged on the neck part, for producing an acoustic warning signal when a limiting bending of the neck part is exceeded as a result of a limiting pressing force in the direction of the use side of the head part being exceeded, wherein the neck part has a cavity, which is closed off from the surroundings and in which the snap dome is arranged, and wherein the device body has a recess, in which the snap dome is arranged, and the recess is closed off from the surroundings by means of a cover part, fitted on the device body, for forming the cavity.

20. The oral hygiene device as claimed in claim 19, wherein the device body has a carrying part with the recess and a holding geometry for the snap dome, and the cover part is fitted on the carrying part.

21. The oral hygiene device as claimed in claim 20, wherein the cover part comprises a frame, of a hard component, and a soft component part closing an opening formed by the frame.

* * * * *